US006695682B2

(12) United States Patent
Sato et al.

(10) Patent No.: US 6,695,682 B2
(45) Date of Patent: Feb. 24, 2004

(54) POLISHING METHOD AND POLISHING APPARATUS

(75) Inventors: Shuzo Sato, Kanagawa (JP); Takashi Suzuki, Kanagawa (JP)

(73) Assignee: Sony Corporation (JP)

( * ) Notice: Subject to any disclaimer, the term of this patent is extended or adjusted under 35 U.S.C. 154(b) by 182 days.

(21) Appl. No.: 09/833,809

(22) Filed: Apr. 13, 2001

(65) Prior Publication Data

US 2002/0022438 A1 Feb. 21, 2002

(30) Foreign Application Priority Data

Apr. 14, 2000 (JP) ..... P2000-118558

(51) Int. Cl.[7] ..... B24B 49/00

(52) U.S. Cl. ..... 451/8; 451/10; 451/11; 451/41; 451/287

(58) Field of Search ..... 451/5, 8, 9, 10, 451/11, 41, 54, 59, 63, 285, 287–288

(56) References Cited

U.S. PATENT DOCUMENTS 6,361,406 B1 * 3/2002 Ohta ..... 451/41

* cited by examiner

*Primary Examiner*—Eileen P. Morgan
(74) *Attorney, Agent, or Firm*—Rader, Fishman & Grauer PLLC; Ronald P. Kananen

(57) ABSTRACT

A polishing method executes those serial processes described below: a theoretically ideal amount of removable object is computed; based on the comparison to the profile when actually processing a polishing object via a chemical-mechanical polishing process, a proportional constant k is sought, which is then utilized as a fixed value; a proper polishing time t is computed; the proper polishing time t is then input into a controller in conjunction with other parameters; by way of feeding a control signal CTL1 to an X-axis servo motor, the controller properly controls X-axis directional velocity of a polishing object; the controller also delivers another control signal CTL2 to a main-shaft spindle motor to control the number of its rotation and delivers another control signal CTL3 to a Z-axis servo motor to control Z-axial directional positioning of a processing head.

10 Claims, 41 Drawing Sheets

POLISHING METHOD AND POLISHING APPARATUS

BACKGROUND OF THE INVENTION

1. Field of the Invention

The present invention relates to a method and an apparatus for flatly polishing a plated film and an insulating film formed on a surface of a wafer, for example.

2. Description of the Related Art

Along with higher integration and further down-sizing of semiconductor devices, contraction of wire diameter and wiring pitch as well as multiplication of wiring layer have been promoted to intensify importance of multiple-layer wiring technology in the semiconductor manufacturing process.

Conventionally, aluminum has mainly been used for composing multiple-layer wiring of semiconductor devices. On the other hand, in order to suppress delayed transmission of signal, in the modern design rule dealing with a maximum of 0.18 $\mu$m rule, such a wiring process by way of replacing aluminum with copper has been developed in recent years. Utilization of copper for wiring provides bilateral advantage in terms of low electric resistance and high resistance against electromigration.

In such a process for applying copper to the wiring for example, initially, metal is embedded in slit-form wiring pattern formed in an inter-layer insulating film, and then wiring is formed by removing excessive metal film via a chemical mechanical polishing (CMP) method. Recently, such a wiring process called "damascene" process has become influential. According to the "damascene" process, an etching process of wiring is not required. And yet, since the upper inter-layer insulating film is leveled off naturally, the "damascene" process advantageously simplifies processing steps.

Further, when introducing "dual damascene" process which initially forms wiring slit and contact holes through the inter-layer insulating film at the same time and then embeds both of them with metal, it is possible to drastically save the steps of the wiring processes.

Referring now to the accompanying drawings, a process for forming wiring by applying the above "dual damascene" process is exemplified below. Note that the wiring is formed with copper in this example.

Initially, as shown in FIG. 39A, an inter-layer insulating film 2 made of silicon oxide is formed on a silicon semiconductor substrate 1 having properly formed impurities-diffused domain (not shown) therein via a low-pressure chemical vapor deposition (CVD) process, for example.

Next, as shown in FIG. 39B, by applying the known photolithographic technique and etching process, a contact hole CH linked with the impurities-diffused region of the semiconductor substrate 1 and slit M for accommodating wiring of a predetermined pattern electrically linked with the impurities-diffused region of the same semiconductor substrate 1 are respectively formed.

Next, as shown in FIG. 39C, a barrier film 4 formed on the surface of the inter-layer insulating film 2, and yet, the same barrier film 4 is also formed through the contact hole CH and inside of the slit M. The barrier film 4 is formed with tantalum Ta, Titanium Ti, TaN, and TiN by applying a known sputtering process. When copper is used for composing wiring and silicon oxide for composing an inter-layer insulating film 2, since copper significantly diffuses into silicon with a substantial diffusion coefficient, copper is easily oxidized. To prevent copper from being oxidized, the barrier film 4 is necessarily formed.

Next, as shown in FIG. 39D, a seed film 5 is formed on the barrier film 4 by way of depositing copper on the barrier film 4 by applying a known sputtering process.

Next, as shown in FIG. 39E, in order to fully embed the contact hole CH and the slit M with copper, a copper film 6 is formed by applying a plating process, or a chemical vapor deposition (CVD) process, or a sputtering process, for example.

Next, as shown in FIG. 39F, excessive portion of the copper film 6 and the barrier film 4 is removed via a chemical mechanical polishing (CMP) process to level off the copper film 6.

By implementing the above serial processes, a copper wiring 7 and a contact 8 are eventually formed. By way of repeatedly implementing the above serial processes on the copper wiring 7, multiple-layer wiring is formed.

When implementing the above-described polishing process, a surface-leveling polishing apparatus is utilized.

FIG. 40 presents a schematic perspective view of a conventional surface-leveling polishing apparatus. The conventional surface-leveling polishing apparatus 20 comprises the following: a rotatable disc-form stationary base 22 adhered with a polishing cloth 21 on the upper surface; a rotatable and vertically movable (in the Z direction) disc-form mounting plate 23 for holding a wafer 10 at the bottom surface; and a nozzle 24 for feeding polishing solution P onto the polishing cloth 21.

When operating the above-referred conventional surface-leveling polishing apparatus shown in FIG. 40, initially, a front surface of the wafer 10 provided with the copper film 6 requiring formation of multi-layer wiring pattern is set prone, and then, the back surface of the wafer 10 is adhered to the bottom surface of the mounting plate 23 or absorbed onto the bottom surface via vacuum pressure.

Next, while jointly rotating the stationary base 22 and the mounting plate 23, polishing solution P is poured onto the polishing cloth 21 via the nozzle 24.

Next, by lowering the mounting plate 23, the front surface of the wafer 10 is pressed against the polishing cloth 21 to polish the copper film 6 requiring formation of the multiple-layer wiring pattern thereon.

Nevertheless, the above conventional surface-leveling polishing apparatus 20 still has a technical problem to solve because polishing amount of the copper film 6 requiring formation of multi-layer wiring pattern thereon still remains unstable inasmuch as the polishing operation is subject to time-control whereby failing to correctly determine actually polished amount until terminating the polishing operation.

Further, polishing precision is variable by actual condition of the polishing cloth 21 whereby unstableness constantly remains in the polishing operation. To secure polishing precision, in many cases, polishing precision is dependent on skill and perception of well-experienced operators.

In addition, because of difference in the removal effect between the inter-layer insulating film 2, the copper film 6, and the barrier film 4, various technical problems such as dishing, erosion (thinning), or recess are apt to be generated.

As shown in FIG. 41A, the above-referred dishing designates such a phenomenon in which, if such a wiring 7 having about 100 $\mu$m of width is present in the design rule for ruling a maximum of 0.18 $\mu$m of width, for example, a center portion of the wiring 7 is excessively removed to generate a recessed portion therein. Once the dishing phenomenon is ever generated, because of shortage of sectional area of the wiring 7, it will cause the wiring 7 to generate an improper electrical resistance value. The dishing phenomenon is apt to be generated when relatively soft copper or aluminum is used for composing the wiring.

On the other hand, as shown in FIG. 41B, the above-referred erosion designates such a phenomenon in which a specific portion provided with a very high pattern density containing wiring having 1.0 $\mu$m of width at 50% density within 3000 $\mu$m of range is excessively removed. Once erosion ever takes place, because of short sectional area of the wiring, it will also cause the wiring to generate an improper electrical resistance value.

Further, as shown in FIG. 41C, the above-referred recess designates such a phenomenon in which stepwise difference is generated as a result of the lowered wiring 7 at the interface between the inter-layer insulating film 2 and the wiring 7. Like the above cases, because of short sectional area of the wiring 7, the wiring 7 will generate an improper electrical resistance value.

On the other hand, when applying the above-referred "damascene" method or "dual damascene" method in particular, inasmuch as the slit for wiring or the wiring slit and the contact hole are simultaneously embedded with copper, excessive copper film 6 generates a substantial film thickness, and yet, inasmuch as projections and recessed portions are generated on the surface of the copper film 6, it is necessary to relax the initial stepwise difference by efficiently removing the excessive copper film 6 via the chemical mechanical polishing (CMP) method.

Accordingly, it is so required that the polishing rate representing a removable amount per unit time should be a minimum of 500 nm/minute, for example. In order to secure the required polishing rate, such a method by way of raising processing pressure against each wafer, utilization of such a chemical solution with stronger etching effect, or such a method by way of raising the number of the rotation of polishing tools, are conceived. However, even when applying any of these methods for improving polishing rate, in terms of precision, it is known that capability for relaxing stepwise difference, in other words, leveling capability, is lowered.

Further, as shown in FIG. 42, scratch (SC) and/or chemical damage (CD) are easily generated on the surface of wiring. In particular, soft copper material easily incurs such damage. Because of this, faulty phenomena such as opened wiring, short-circuited wiring, improper electrical resistance value of the wiring, are apt to be generated. Further, when applying any of the above-cited processing methods to improve the polishing rate, there is such a disadvantage in which crack, stripping of inter-layer insulating film, dishing, erosion, and recessed portions, are increasingly generated.

On the other hand, in order to eliminate unstableness caused by variable condition of the polishing cloth 21 and minimize the dependence on experienced skill and perception of experienced operators as much as possible, such a polishing apparatus capable of securing satisfactory leveling effect in the chemical mechanical polishing process by means of a rigid-type polishing wheel has been realized so that uniform effect of correction via software controlling method by way of dispensing with experienced human skill can be materialized.

Nevertheless, actually, the above-cited uniform effect of correction via utilization of the above polishing apparatus is still dependent on experienced skill and perception of experienced operators to a large extent, and thus, substantial skill is still required for preparation of so-called recipe.

When operating the above polishing apparatus to execute such a process to remove excessive copper film by causing an annular-shaped wheel to be abutted with a circular-form wafer partially, since the annular-shaped wheel not only strictly executes partial processing of the circular wafer, but it also processes a certain area of the wafer, it makes it difficult to properly adjust recipe for partially correcting removable amount of excessive copper film.

In addition, when varying tilt angle of the main shaft, even such a well-experienced operator often finds unexpected result from the correction process, and thus, in terms of the uniform effect of correction, actually, variation of the removable amount of copper film against a variety of input parameters is not yet determined quantitatively.

Concretely, when operating such a conventional polishing apparatus, in order to improve and maintain uniform effect of correction on the way of continuously processing a wafer, it is imperative that change and correction be executed against a variety of processing parameters repeatedly in accordance with forecast based on experiences of operators. Accordingly, process margin in the production of semiconductor devices is not determined by the applied device system, but it still largely hinges on expertise of operators.

SUMMARY OF THE INVENTION

The present invention has been achieved in consideration of the above circumstances. The object of the present invention is to provide such a method and an apparatus for polishing a plated film and an insulating film formed on a wafer surface, which are capable of stably improving polishing rate and securing high processing precision while maintaining capability to relax initial stepwise difference, i.e., projections and recessed portions, in the course of leveling off metallic film such as copper wiring while steadily preventing faulty phenomenon such as dishing and erosion from occurrence without being swayed by skilled expertise of operators.

In order to achieve the above object, the present invention provides a method for flatly polishing surface of a polishing object by shifting surfaces of a polishing means and a polishing object relative to each other in a predetermined direction based on a polishing condition prescribed by processing pressure P, relative velocity "v" between the polishing means and the polishing object, and polishing time "t". Initially, this method computes distribution of the removable amount of copper material on the surface of the polishing object generated by influence of a variety of processing parameters based on a proportional constant "k" determined by the polishing status and also based on the Preston's equation prescribed by the polishing condition. Next, the method computes a proportional constant "k" capable of generating uniformly flat distribution of the removable amount computed by Preston's equation. Next, the method computes distribution of the removable amount based on a proportional constant "k" as a fixed value. Finally, the method sets a polishing condition that enables distribution of the removable amount to secure uniform levelness when the above-referred proportional constant "k" functions as a fixed value.

Further, when implementing the present invention, the above-referred polishing condition based on the Preston's equation is set by prescribing the polishing time "t" when the above-referred processing pressure P and the relative velocity "v" are respectively utilized as a fixed value.

Further, when implementing the present invention, the above-referred polishing condition based on the Preston's equation is set by prescribing the above-referred relative velocity "v" when the above-referred processing pressure P and the polishing time "t" are respectively utilized as a fixed value.

Further, in the present invention, the above-referred polishing object is substantially a semiconductor wafer itself, wherein polishing of the wafer is executed in the direction of relaxing peak of polishing directivity prescribed at the time of polishing by the polishing means or in the direction of averaging polishing direction in the center portion of the wafer.

Further, in the present invention, initially, variation of superficial reflectivity of the above-referred polishing object is detected, and then, based on the detected value, remaining unscraped portion of the polishing object is identified. Finally, practicable polishing condition against the remaining unscraped portion and such portions other than the remaining unscraped portion are automatically generated.

Further, in the present invention, by way of measuring film thickness of the polishing object, such a portion requiring removal of excessive copper material is detected, and then, based on the detected value, practical condition for processing the detected portion is automatically generated.

Further, in the present invention, the above-referred polishing object comprises copper wiring. By way of measuring variation of sheet resistivity during off-line period, parameter necessary for correcting the removable amount is calculated, and then, by way of automatically correcting the removing condition, a proper condition for securing uniformity of the removable amount is prepared.

Further, the present invention provides such a polishing apparatus which initially shifts surfaces of a polishing means and a polishing object in a predetermined direction relative to each other, and then flatly polishes surface of the polishing object by applying a polishing condition prescribed by the preset processing pressure P, relative velocity "v" between the polishing means and the polishing object, and polishing time "t". The polishing condition is set at a specific value enabling distribution of a second removable amount to secure uniform levelness when distribution of a first removable amount on the surface of the polishing object applies proportional constant "k" for securing uniform levelness as a fixed value, where the distribution of the first removable amount on the surface of the polishing object is generated by influence of a variety of processing parameters computed by the proportional constant "k" determined by the polishing condition and in accordance with Preston's equation prescribed by the polishing condition.

Further, the polishing apparatus provided by the present invention comprises detecting means for detecting variation of superficial reflectivity of the above-referred polishing object and controlling means which, based on the detected value, identifies remaining unscraped portion of the polishing object and then automatically generates a proper polishing condition against the remaining unscraped portion and such portions other than the remaining unscraped portion.

According to the present invention, distribution of the removable amount of excessive copper film on the surface of a polishing object generated by influence of a variety of processing parameters is computed based on a proportional constant "k" determined by the polishing status and in accordance with Preston's equation prescribed by processing pressure P, relative velocity "v" between the polishing means and the polishing object, and the polishing time "t".

Next, such a proportional constant "k" enabling distribution of the removable amount to secure uniform levelness is computed.

Next, such a distribution of the removable amount by applying the proportional constant "k" as a fixed value is computed to enable establishment of such a specific polishing condition for enabling the distribution of the removable amount to secure uniform levelness.

Finally, by applying the polishing condition set by the polishing means, surface of the polishing object is properly scraped off.

As is apparent from the above description, according to the present invention, the inventive polishing method and apparatus provide such a useful advantage by way of assuredly preventing dishing and erosion from occurrence without being swayed by skill and perception of experienced operators, and yet, in the course of leveling off copper film or the like via a polishing process, it is possible to improve the polishing rate while preserving initial capability to relax stepwise difference caused by projections and recesses, whereby making it possible to constantly achieve very high processing precision.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DESCRIPTION OF THE PREFERRED EMBODIMENTS

Referring now to the accompanying drawings, an optimal form for implementing the present invention is described below.

Inasmuch as the practical form for implementing the invention described below represents an optimal example of the present invention, a variety of technically suitable limits are imposed. However, it should be understood that the scope of the present invention is by no means limited to those practical forms described below unless there is no special remark to limit the scope of the present invention.

Figure 1:
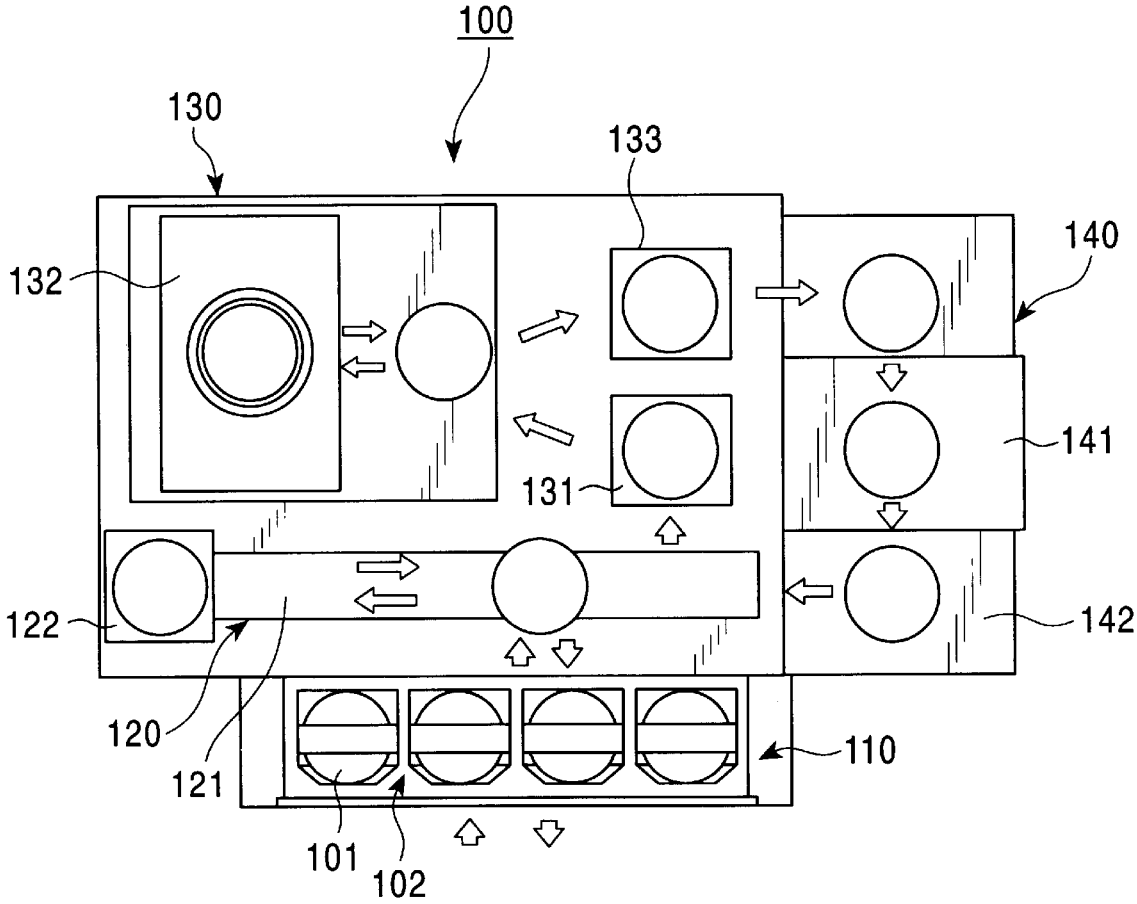
FIG. 1 is a plan view designating an overall construction of the surface-leveling polishing apparatus according to an embodiment of the present invention.

FIG. 1 presents a schematic plan view of an overall structure of a surface-leveling polishing apparatus used for implementing the polishing method related to the present invention as a practical form to realize the present invention.

Briefly, the surface-leveling polishing apparatus 100 related to the present invention comprises the following: a cassette port 110 for accommodating a wafer 101 as the polishing object, a handling system 120 for positioning the wafer 101 drawn out of the cassette port 110, a polishing head 130 for chemically and mechanically polishing each wafer 101 positioned by the handing system 120, and a cleaner 140 for washing the wafer 101 completed with chemical/mechanical polishing by applying the polishing head 130.

It is so arranged that each piece of the wafers 101 is conveyed between the above structural components via robots not shown in the drawings.

A conventional wafer polishing process performed inside of the surface-leveling polishing apparatus 100 incorporating the above structure is described below.

Initially, a plurality of wafers 101 are stored in parallel inside of a cassette 102. Next, the cassette 102 is set in the cassette port 110. Next, a piece of wafer 101 is drawn out of the cassette 102 and then conveyed to the handing system 120.

The conveyed wafer 101 is then shifted to a positioning unit 122 via a conveyer 121, and then, the wafer 101 is subject to a centering process and an "orientation flat alignment". Next, the wafer 101 is again shifted to the original position via the conveyer 121. The wafer 101 being back to the original position is then shifted to the polishing head 130. Then, the wafer 101 is once put in a buffer 131, and then secured to a processing unit 132, and then the wafer 101 is treated with a chemical/mechanical polishing process while measuring the polishing status. After completing the polishing process, the wafer 101 is once transferred to a wet station 133 and then conveyed to the cleaner 140.

The conveyed wafer 101 is then routed through a washing unit 141 in which the wafer 101 is washed with chemical solution, and then conveyed to a dryer unit 142 for drying washing solution. The fully dried wafer 101 is again conveyed to the handing system 120 and then stored in a vacant portion of the cassette 102. After fully completing the above serial processes against all the wafers 101 stored in the cassette 102, the cassette 102 is drawn out of the cassette port 110 and then conveyed to the following processes.

Figure 2:
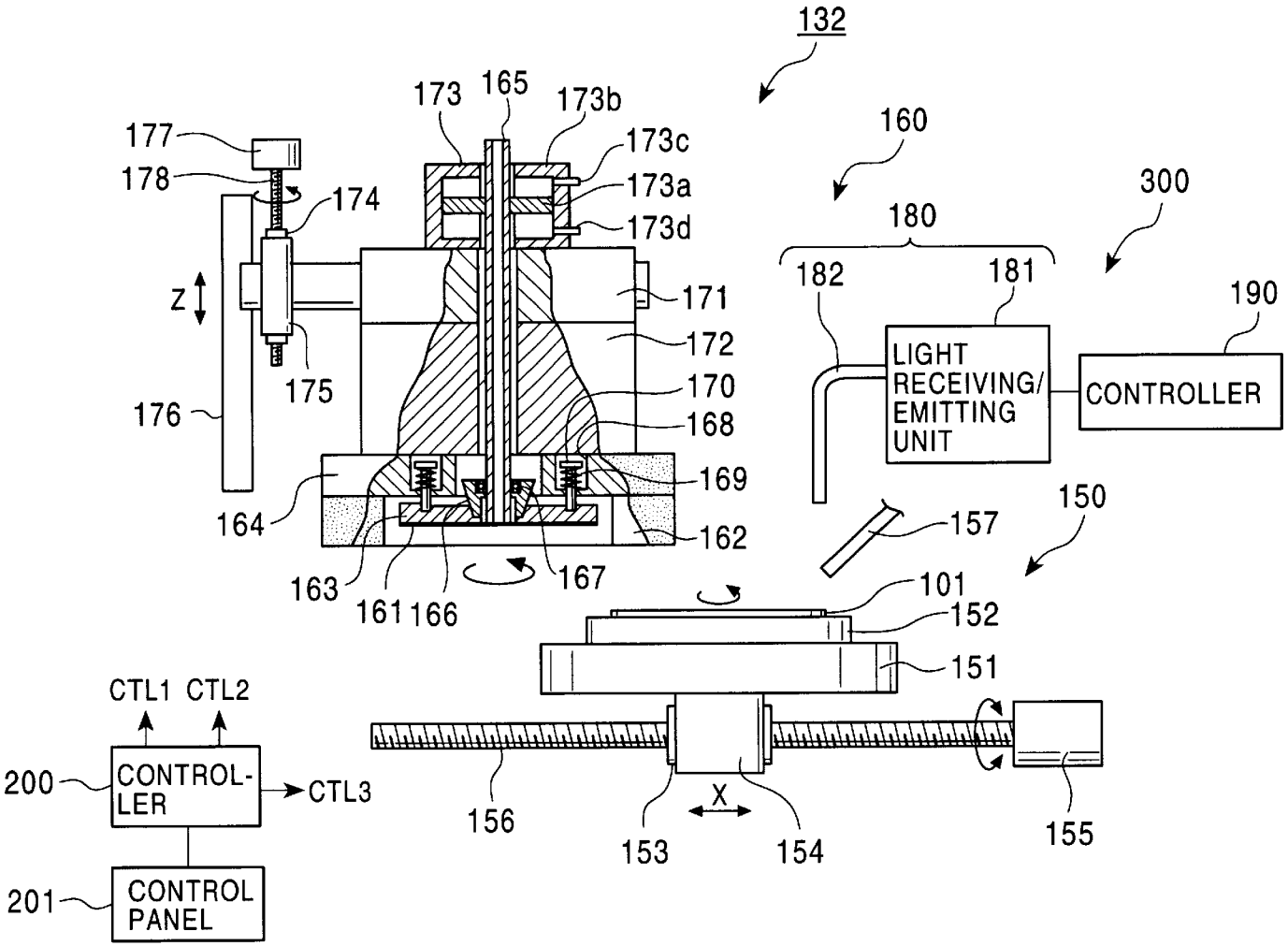
FIG. 2 is a partially sectioned lateral view designating detailed processing mechanism of the surface-leveling polishing apparatus shown in FIG. 1.

FIG. 2 presents a partially sectioned lateral view designating a detailed mechanism of the processing unit 132 constituting part of the surfaced-leveling polishing apparatus 100 shown in FIG. 1.

The processing unit 132 mainly comprises a processing table 150, a processing head 160, and a polishing-status measuring unit 300.

The processing table 150 has such a function to fixedly mount the wafer 101 to cause the wafer 101 to be rotated and then shifted in the X-direction.

A wafer chuck 152 for absorbing the wafer 101 via vacuum pressure is disposed on the upper surface of a base plate 151, whereas a supporting unit 154 fitted with an X-axis ball nut 153 is disposed to the bottom surface of the base plate 151.

An X-axis servo motor 155 is linked with the X-axis ball nut 153 with which an X-axis ball screw 156 extending itself in the X direction is coupled. Further, a nozzle 157 for feeding polishing solution is disposed above the base plate 151. Although not shown, the base plate 151 incorporates such a mechanism for rotating the wafer chuck 152.

The processing head 160 exerts such a function to chemically/mechanically polish the wafer 101 secured to the processing table 150 via dual stages after shifting itself in the Z-direction. A disc-shaped buff 161 having a diameter substantially identical to that of the wafer 101 and an annular-shaped wheel 162 having an inner diameter greater than the diameter of the buff 161 are coaxially disposed by way of forming concentric circles. The buff 161 itself is adhered to the bottom surface of an annular-shaped stationary metal base plate 163, whereas the wheel 162 itself is adhered to the bottom surface of an annular-shaped metal-tool flange 164.

An end of a shaft 165 is fixed through the center hole of the stationary metal base plate 163 via a flange 167 fitted with a bearing 166. Outer circumferential surface of the flange 167 is tapered and fixedly coupled with the tapered inner circumferential surface of the center hole of the stationary metal base plate 163. A plurality of counter borings 168 are disposed on the upper-surface side of the metal-tool flange 164 at equal angular intervals.

A pin 170 fitted with a spring 169 is inserted into the interior portion of each counter boring 168 by way of thrusting through the bottom surface of the metal-tool flange 164. The tip of the pin 170 is coupled with the upper surface of the stationary metal base plate 163 via screwing. A main-shaft spindle 172 fitted with a main-shaft spindle-motor 171 is secured to the upper surface of the metal-tool flange 164. Further, an air cylinder 173 is secured to the upper portion of the main-shaft spindle motor 171.

The shaft 165 is disposed by way of thrusting itself through the center hole of the metal-tool flange 164, and further through the center portion of the main-shaft spindle 172, the main-shaft spindle motor 171, and the air cylinder 173. A piston 173*a* of the pneumatic cylinder 173 is secured to the other end of the shaft 165. In order to feed polishing solution, the shaft 165 is formed into hollow cylindrical structure.

A supporting unit 175 fitted with a Z-axis ball nut 174 is disposed on the outer circumferential surface of the main-shaft spindle motor 171. The supporting unit 175 is secured to a Z-axis guide 176. The Z-axis ball nut 174 is coupled with a Z-axis ball screw 178 which is linked with a Z-axis servo motor 177 and extending itself in the Z direction.

Acting on a control signal from the controller 200, the X-axis servo motor 155 controls moving speed of the wafer 101 in the X-axial direction. The number of the rotation of the main-shaft spindle motor 171 is controlled by a control signal from the controller 200. Further, based on a control signal from the controller 200, the Z-axis servo motor 177 controls positioning of the processing head 160 in the Z-axial direction.

Figure 3:
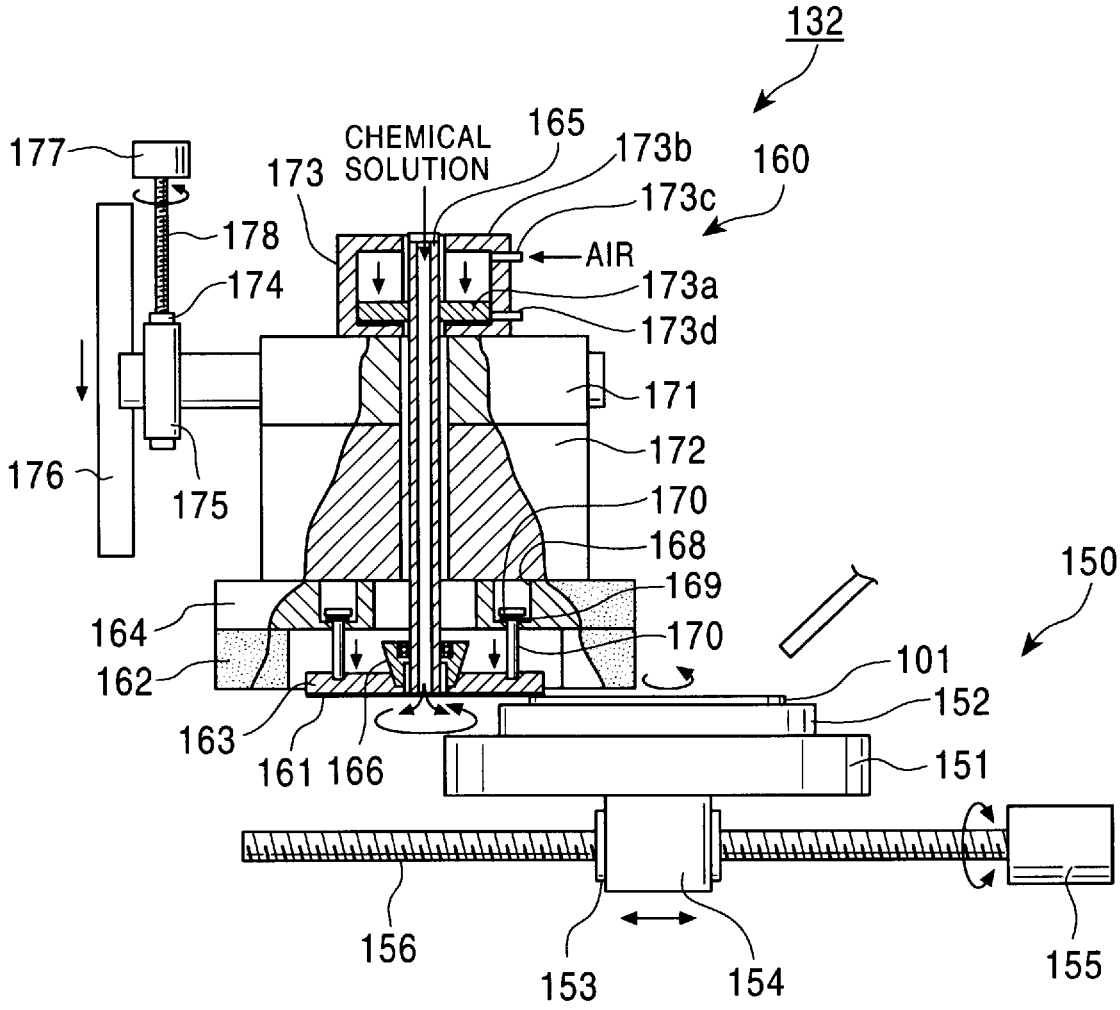
FIG. 3 is a cross-sectional lateral view for exemplifying operation of the surface-leveling polishing apparatus shown in FIG. 1.

FIG. 3 designates such a case in which the processing head 160 has just entered into a polishing-status after descending itself via positioning control executed by the Z-axis servo motor 177.

When the polishing-status is entered, the stationary metal base plate 163 compresses the spring 169 whereby causing the polishing surface of the buff 161 to project itself from the polishing surface of the wheel 162. The stationary metal base plate 163 then presses the polishing surface of the buff 161 against the surface of the wafer 101 and then causes the X-axis ball screw 156 to be rotated by way of driving the X-axis servo motor 155 whereby causing the base plate 151 to perform reciprocating movement via the supporting unit 154 to chemically and mechanically polish the wafer 101. While this process is underway, it is possible to properly control absolute value of the polishing amount mainly via the actual pressure of the air cylinder 173 and via the moving velocity of the buff 161 while passing through the wafer 101.

The controller 200 exerts such a function to fully control the polishing apparatus. In particular, as mentioned above, the controller 200 controls moving velocity of the wafer 101 in the X-axial direction by way of feeding a control signal CTL1 to the X-axis servo motor 155, and at the same time, it also controls the number of the rotation of the main-shaft spindle motor 171 by way of feeding a control signal CTL2 thereto. Further, by way of feeding a control signal CTL3 to the Z-axis servo motor 177, the controller 200 also controls positioning of the processing head 160 in the Z-axial direction.

Control on the positioning of the processing head 160 in the Z-axial direction corresponds to the control of thrusting pressure (processing pressure) of the buff 161 against the surface of the wafer 101 relative to the Z-axial directional position of the processing head 160.

Such a control panel 201 connected to the controller 200 is operated by an operator, for example, by inputting a variety of data including a variety of processing parameters, i.e., data of moving velocity of the wafer 101 in the X-axial direction, data of the number of the rotation of the main-shaft spindle motor 171, Z-axial directional positioning data of the processing head 160 (i.e. processing pressure data), and yet, the control panel 201 displays monitoring data.

In an embodiment of the present invention, initially, distribution of the removable amount of excessive copper film on the surface of the wafer 101 to be generated by influence of a variety of processing parameters is calculated in accordance with the Preston's equation (described later on), and then, based on the calculated result, uniformity is corrected by way of optimizing and automatically correcting a variety of processing parameters.

More specifically, in the embodiment of the present invention, in order that correction of uniformity can be executed quantitatively and skilllessly, chemical-mechanical polishing process is simulated in conformity with the Preston's equation, and then, based on the resultant value, a variety of processing parameters are optimized.

Next, the surface-leveling polishing method related to the present invention is serially described below by way of referring to the accompanying drawings.

It is an object of the inventive forecast method (i.e., simulation method) to initially implement a simulation to forecast a removable amount of excessive copper material that can theoretically be forecast based on a geometric form of the wafer 101 and the geometric forms of the wafer and a wheel (including a buff) and also based on the Preston's polishing rule, and then based on theoretical view, variable condition of uniformity against a variety of input parameters is quantitatively related therewith.

(A) Preston's Equation

When executing a wafer surface polishing process using free whetstone particles, based on the Preston's equation, the removable amount is expressed by the equation (1) shown below.

$$M=kPvt \tag{1}$$

wherein M designates the removable amount; k designates a proportional constant to be determined by an actual polishing status; P designates processing pressure; v designates a relative velocity between used tools and a processing object; and t designates actual polishing time.

Based on the above equation (1), the removal amount M is computed.

More particularly, according to the inventive method, initially, a theoretical (ideal) removable amount is computed. Next, a proportional constant k is computed in comparison to the profile when actually executing the chemical/mechanical polishing process to utilize the resultant value as a fixed value. Next, by applying the above Preston's equation, a proper polishing time t is computed when utilizing processing pressure P and relative velocity v as fixed values among the polishing condition prescribed by means of the processing pressure P, relative velocity v, and the polishing time t.

When applying the Preston's equation, it is also possible to compute a proper relative velocity v when utilizing the processing pressure P and the polishing time t as fixed values among the polishing condition prescribed by means of the processing pressure P, relative velocity v, and the polishing time t.

More concretely, initially, based on the Preston's equation prescribed by means of the proportional constant k determined by a polishing status, and the processing pressure P, relative velocity v, and the polishing time t, distribution of the removable amount on the surface of the polishing object generated by influence of a variety of parameters is computed, and then, such a proportional constant k enabling the computed distribution of the removable amount to secure uniform levelness. Next, distribution of the removable amount using the computed proportional constant k as a fixed value is computed. Then, a proper polishing time t when utilizing the processing pressure P and the relative velocity v as fixed values is computed among the polishing conditions secure uniform levelness is computed.

Alternatively, a proper relative velocity v is computed among the polishing conditions when utilizing the processing pressure P and the polishing time t as fixed values.

(B) Assumption in the Course of a Simulation

B-1: Pressure Components

While executing a polishing process with the inventive polishing apparatus 100, a torus-shapes rigid pad wheel having an outer diameter of 200 mm and a bore diameter of 160 mm, for example, is brought into contact with a wafer by inclining the rigid pad wheel against a vertical shaft (the main shaft) by scores of micrometers.

Figure 4:
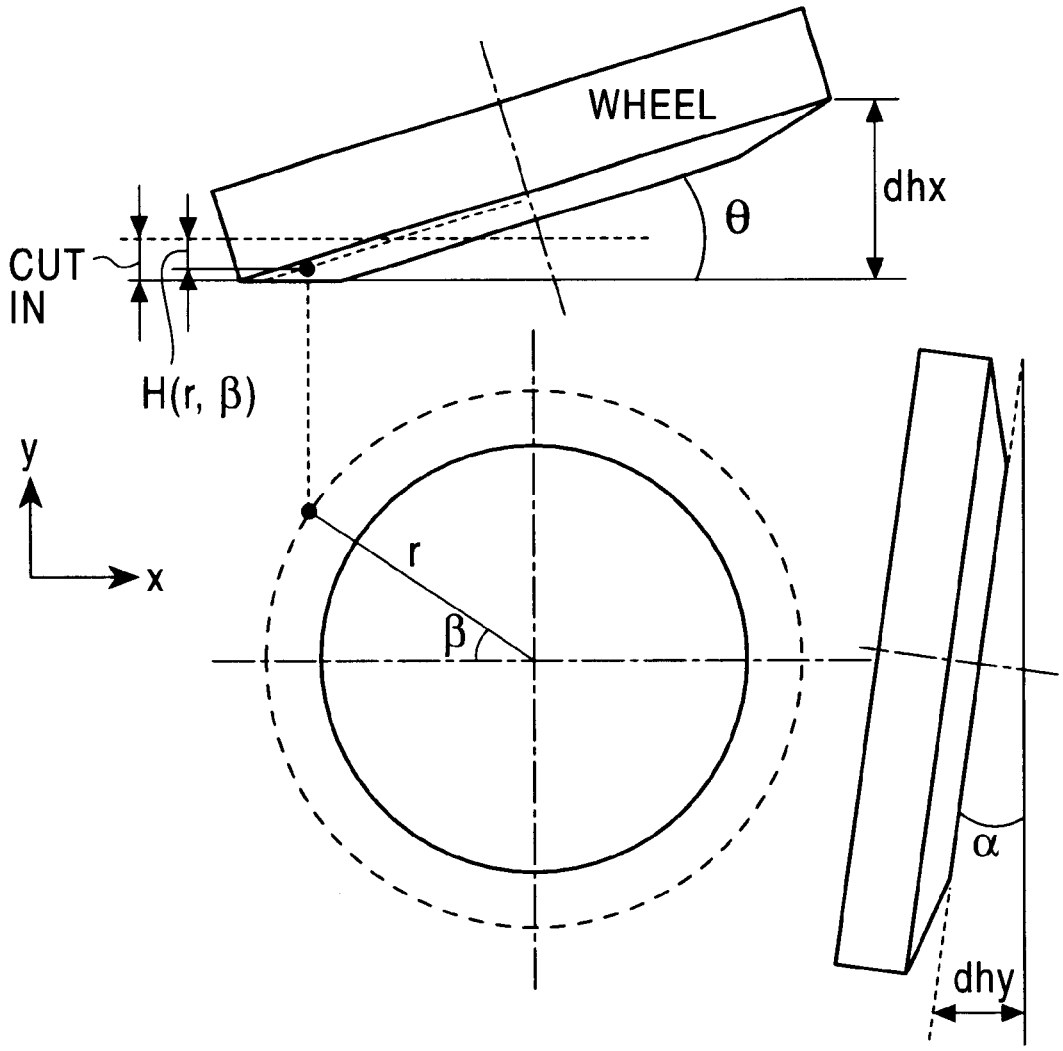
FIG. 4 is a geometric chart for explanatory of contact condition between a wheel and a wafer.

When this condition is entered, the abutted condition between the rigid pad wheel and the wafer is geometrically shown in FIG. 4.

In FIG. 4, the reference character H designates the value (deformed amount of whetstone) of an actual CUT-IN, dhx designates the inclined amount in the x-axial direction, dhy designates the inclined amount in the y-axial direction, and r designates radius of a point at which the whetstone is present.

The following relationship is established between these parameters H, dhx, and dhy, and the tilt angle θ.

$$H(r, \theta)=\text{CUTIN}-r(1-\cos\beta)\cdot\tan\theta-r\sin\beta\tan\alpha \tag{2}$$

$$\tan\theta=\text{dhx}/200\text{ mm} \tag{3}$$

$$\tan\alpha=\text{dhy}/200\text{ mm} \tag{4}$$

Figure 5:
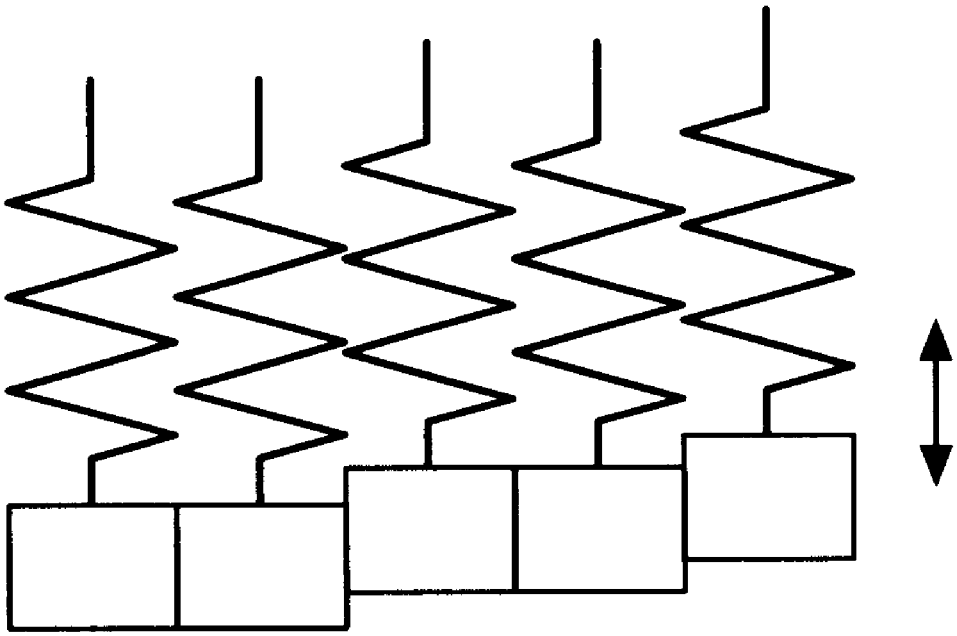
FIG. 5 is a first assumptive chart for executing a simulation.
Figure 6:
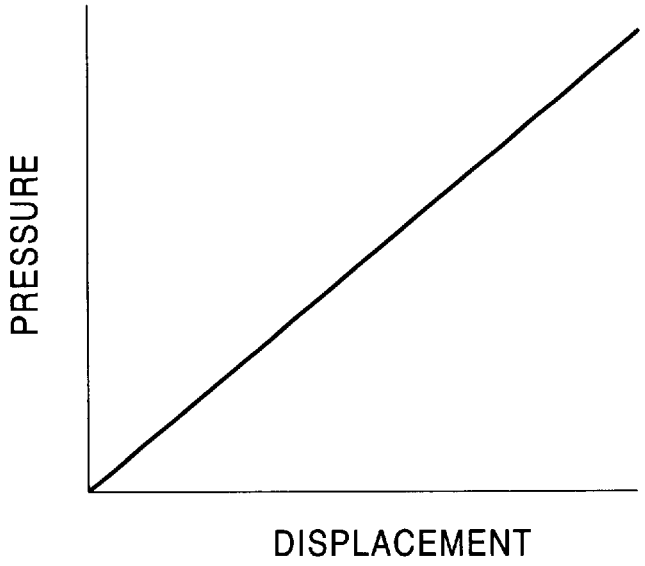
FIG. 6 is a second assumptive chart for executing a simulation.
Figure 7:
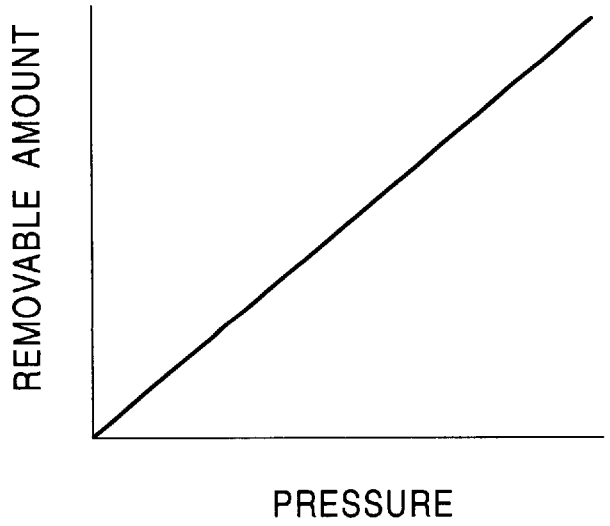
FIG. 7 is a third assumptive chart for executing a simulation.

As shown in FIGS. 5–7, three kinds of assumptions are set for implementing a simulation.

First, as shown in FIG. 5, although whetstone is actually a continuous elastic body, it is assumed that the whetstone is an assemblage of microscopic fine elastic bodies independently and solely movable only in the vertical direction.

Second, as shown in FIG. 6, it is assumed that displacement and pressure of the whetstone are proportional to each other.

Third, as shown in FIG. 7, it is assumed that the pressure and the removable amount are fully proportional to each other.

B-2: Velocity Component

Figure 8:
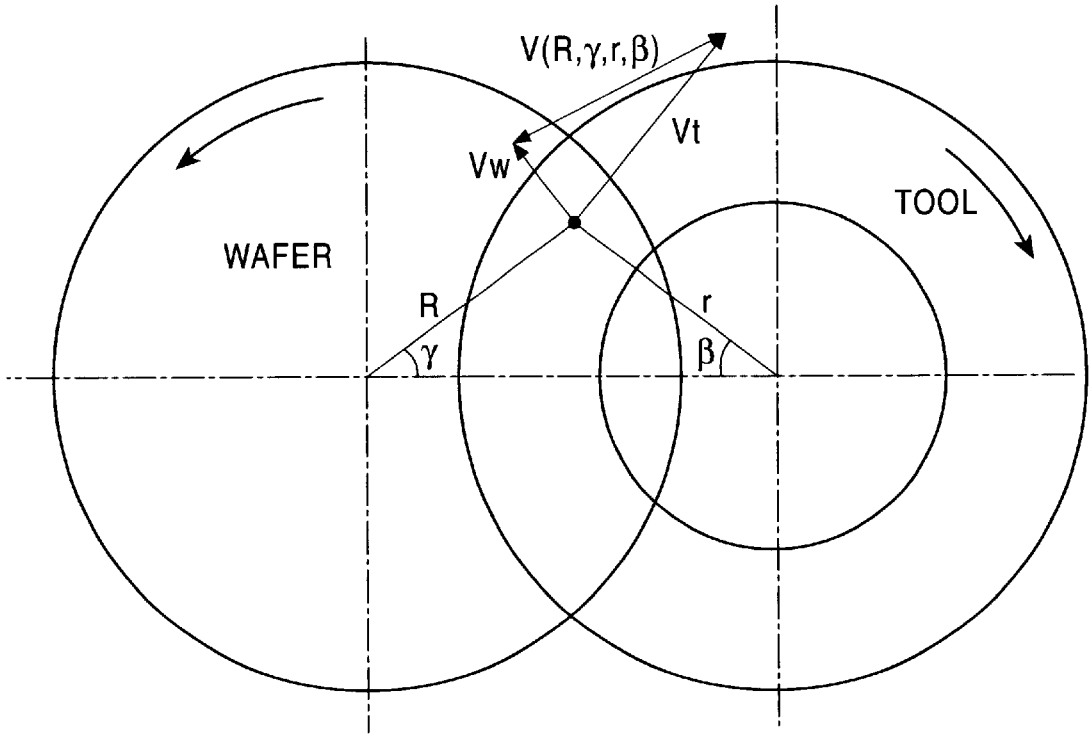
FIG. 8 is a geometric chart designating relative velocity between a wheel and a wafer.

Like the case of pressure component, relative speed between a wafer and a wheel is geometrically shown in FIG. 8.

In FIG. 8, assuming that R designates radius of a wafer, r designates radius of a wheel, ωw designates angular velocity of the wafer, and ωt designates angular velocity of a wheel, then, the following relationship is established.

$$V(R, \gamma, r, \beta)=(Vt^2+Vw^2-2Vt\cdot Vw\cdot\cos(\gamma+\beta))^{1/2} \tag{5}$$

$$Vw=R\cdot\omega w \tag{6}$$

$$V^t=R\cdot\omega t \tag{7}$$

Figure 9:
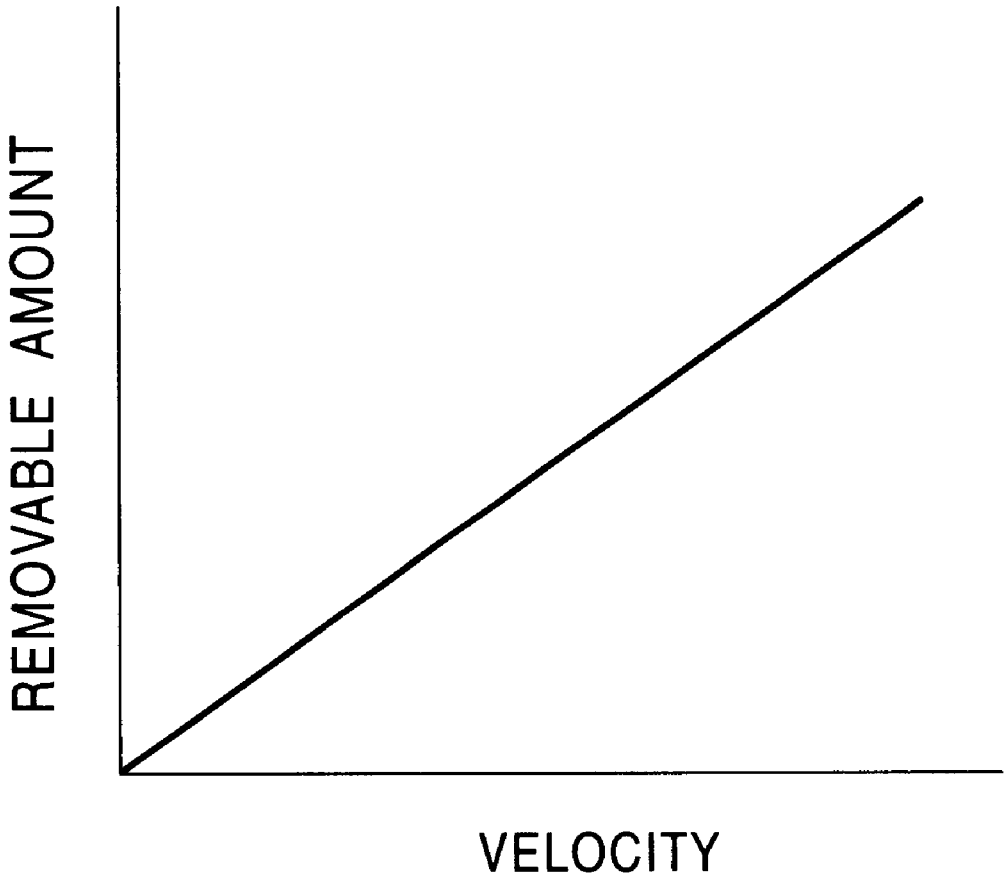
FIG. 9 is a chart for explanatory of the relationship between a polishing amount and velocity when executing a simulation.

It is assumed that the relationship between the polishing amount and velocity is fully proportional to each other as shown in FIG. 9. Further, it is also assumed that polishing capability of whetstone is not degraded on the way of processing a single wafer. It is also assumed that each wafer has a fully leveled flat surface and slurry is evenly supplied.

Based on the above assumption, ratio of polishing amount at every local point becomes as the one shown in the following equation.

$$M=\int H\cdot vdt \tag{8}$$

By way of computing a proportional constant k via an experiment followed by execution of multiplication, it is possible to compute actually removable amount of the wafer.

(C) Simulation Software

Figure 10:
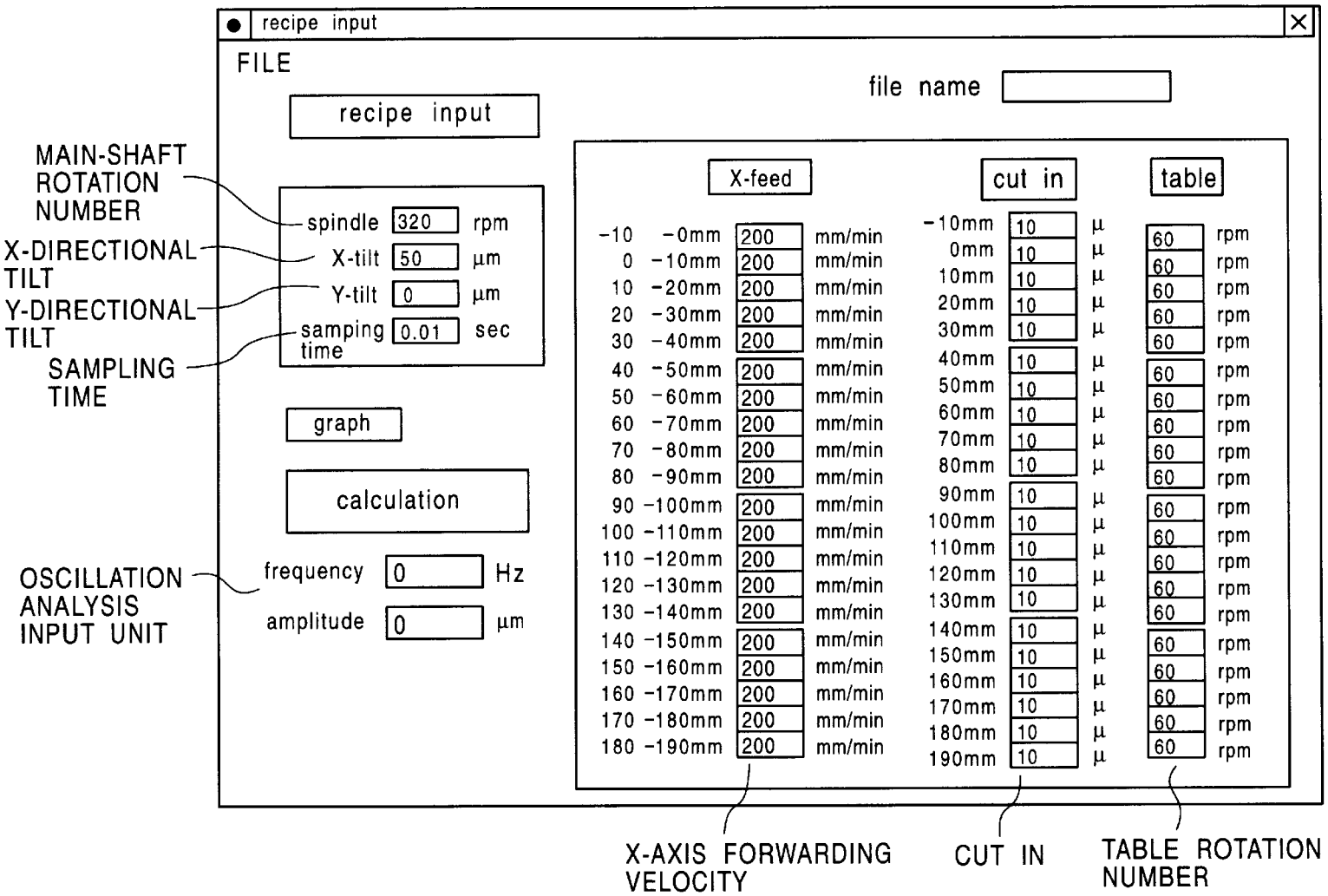
FIG. 10 is a chart for explanatory of simulation software related to the present invention, where the chart designates a recipe input screen.

C-1: Simulation Software to Assess Removable Amount within Two-dimensional Surface As shown in FIG. 10, simulation software for implementing the present invention inputs a variety of requirements including the number of the rotation of the main shaft, velocity for forwarding X-axis at every local position, CUT-IN rate, the number of the rotation of the processing table, and tilt amount of the main shaft in the X–Y directional mechanical setting value.

Figure 11:
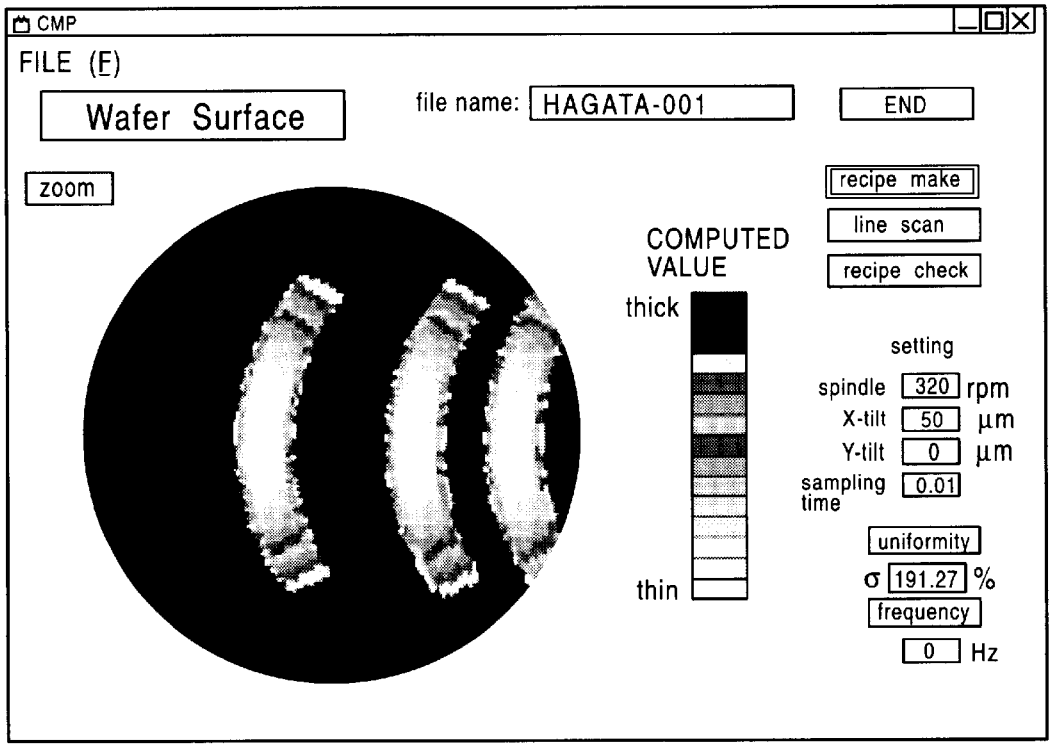
FIG. 11 is a chart for explanatory of another simulation software related to the present invention, where the chart designates a computation result output screen.

The above requirements are respectively computed based on discrete time. In order to implement this, sampling duration is input to visually express actual condition of the removal amount within surface of the wafer as shown in FIG. 11. Note that the shorter the sampling duration, the higher the precision of the result from the computation.

FIG. 11 represents the result of computation of the distribution of polishing amount called "contact area pattern" which is formed when internally cutting the Z-axis after stabilizing rotation of the processing table.

Division inside of the wafer surface is effected by 50 points at 2 mm of pitch in the radial direction, for example. On the other hand, angular division is effected by way of the following:

0–20 mm: at 5 degrees of pitch

20–40 mm: at 4 degrees of pitch

40–60 mm: at 3 degrees of pitch

60–100 mm: at 2 degrees of pitch

It is so arranged that a total of 6300 points of the removable amount can be calculated.

C-2: Simulation Software to Assess Removable Amount within One-dimensional Surface Execution of simulation software to assess removable amount within one-dimensional surface is effective for analysis in such a case in which removable amount within one round becomes uneven because of the number of the rotation of the processing table, forwarding velocity, or due to oscillation of the processing system. However, in an actual processing stage, since these components are quite negligible, it is safe to assume that the removable amount within circumference remains constant.

Accordingly, by way of computing distribution of the removable amount solely in the radial direction, it is possible to shorten computing time. An actual example is shown in FIG. 12.

Figure 12:
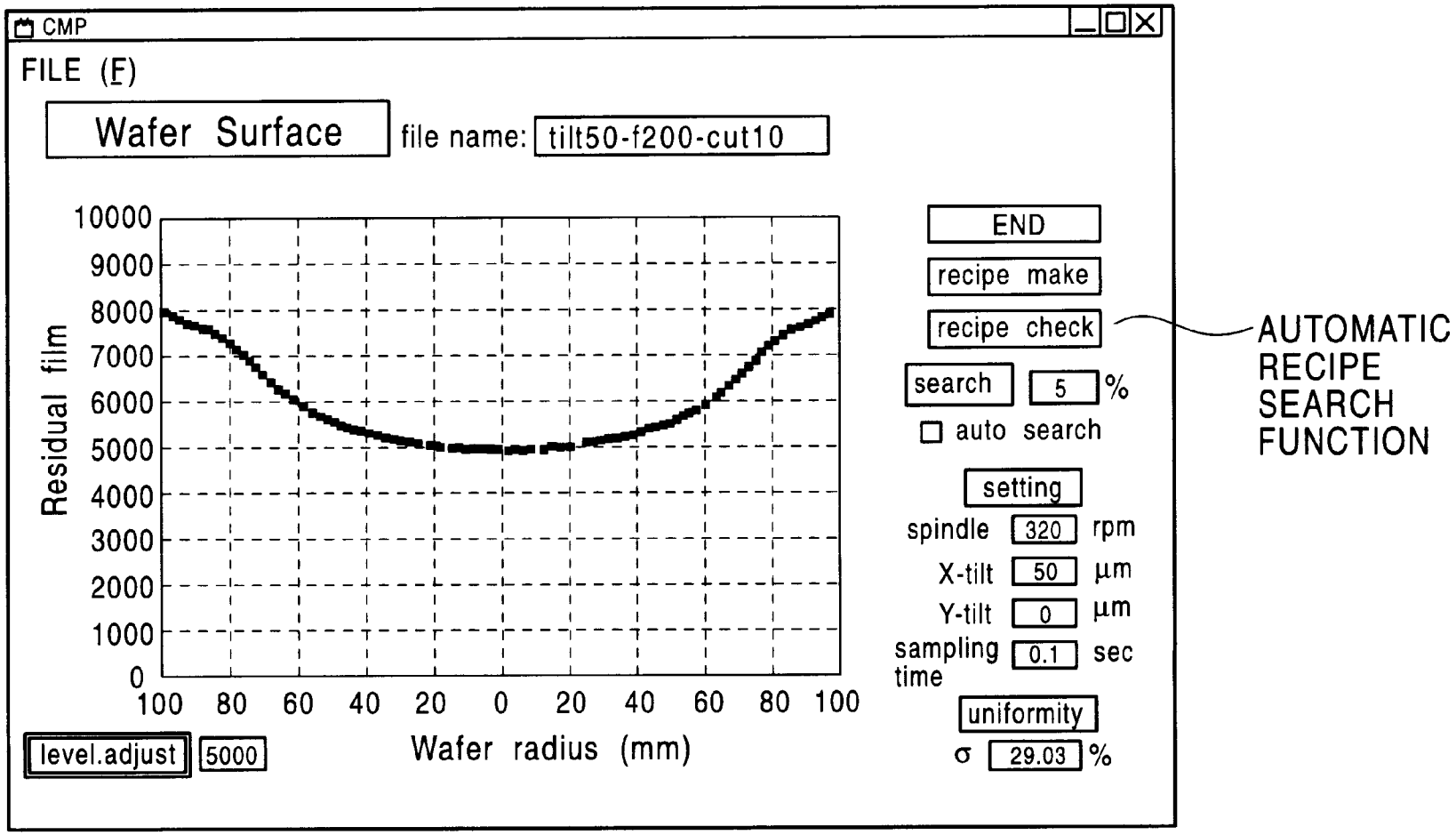
FIG. 12 is a chart for explanatory of a still further simulation software related to the present invention, where the chart designates one-dimensional simulation screen.

The simulation software shown in FIG. 12 is added with such a function to automatically search a proper recipe capable of securing uniformity by causing X-axis forwarding velocity to be varied from a certain polishing condition generated by a certain recipe.

(D) Comparison with Experimental Value

D-1: Comparison between CUT-IN Value via Recipe and Actual CUT-IN Value

Figure 13:
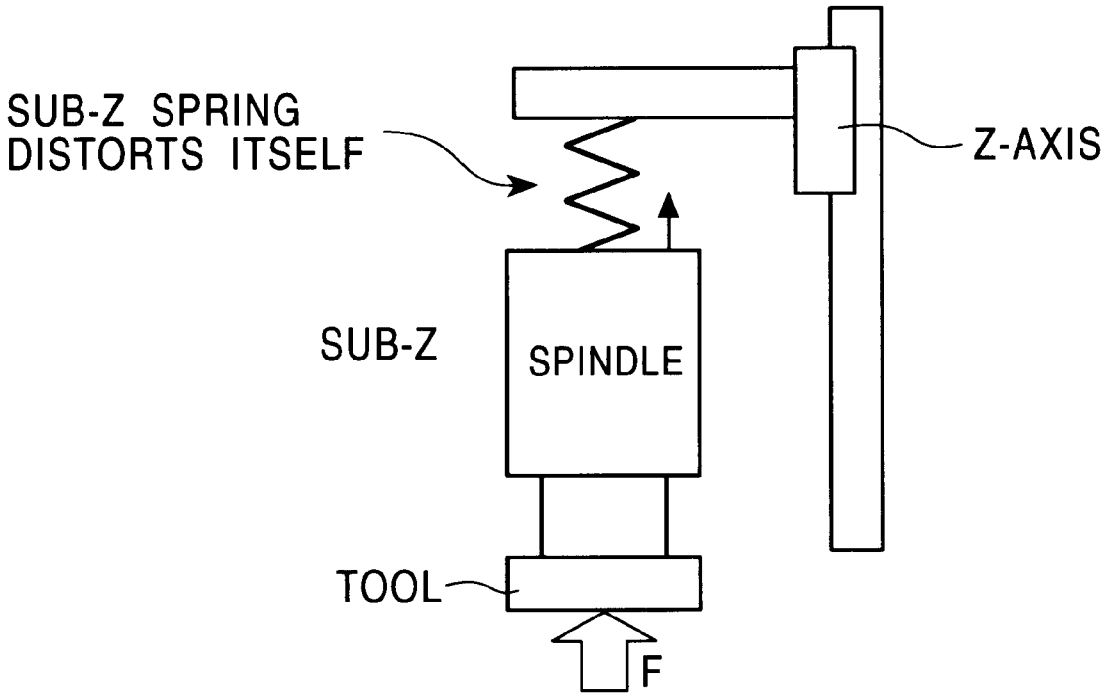
FIG. 13 is an explanatory view of an actual thrust amount of whetstones.

By operating a recipe editor related to this embodiment the present invention, it is possible to input a CUT-IN value by three digits based on micrometer ($\mu$m) unit. For example, when removing thermally oxidized film by 5000 Å, the CUT-IN command effects input of such a value corresponding to about 50–90 $\mu$m. Nevertheless, as shown in FIG. 13, due to distortion of SUB-Z-axis, the actual whetstone thrust amount becomes less than the commanded value.

Figure 14:
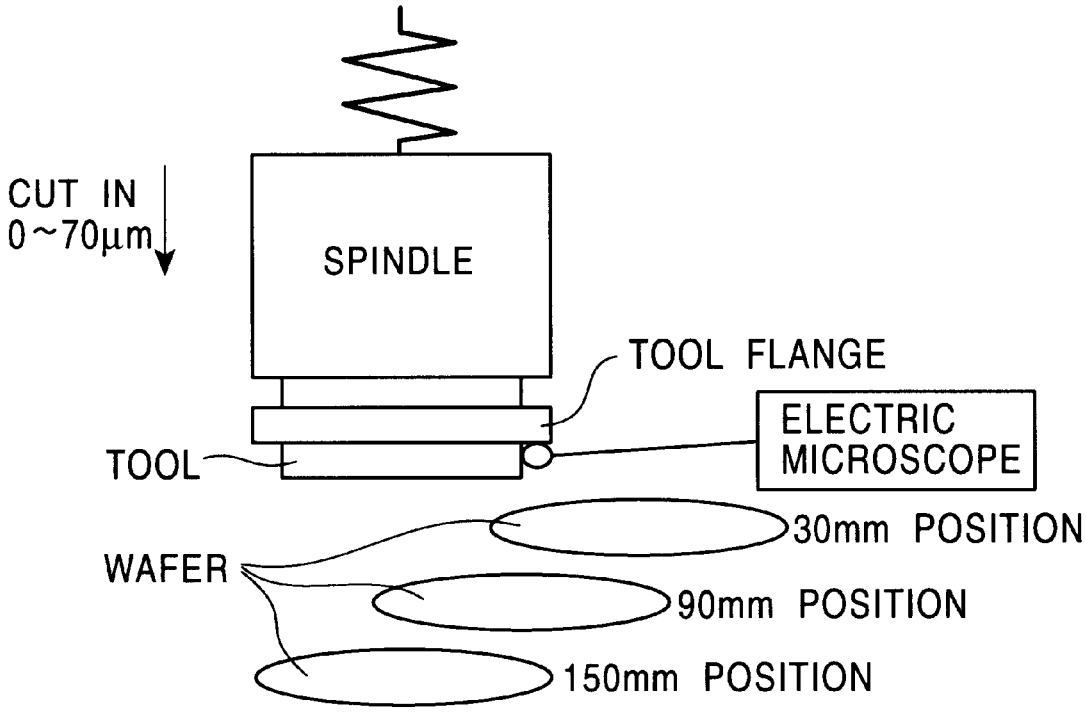
FIG. 14 is an explanatory view of a method of measuring actual cutting operation.

To probe this effect, the actual whetstone thrust amount was measured in accordance with the procedure shown in FIG. 14.

Figure 15:
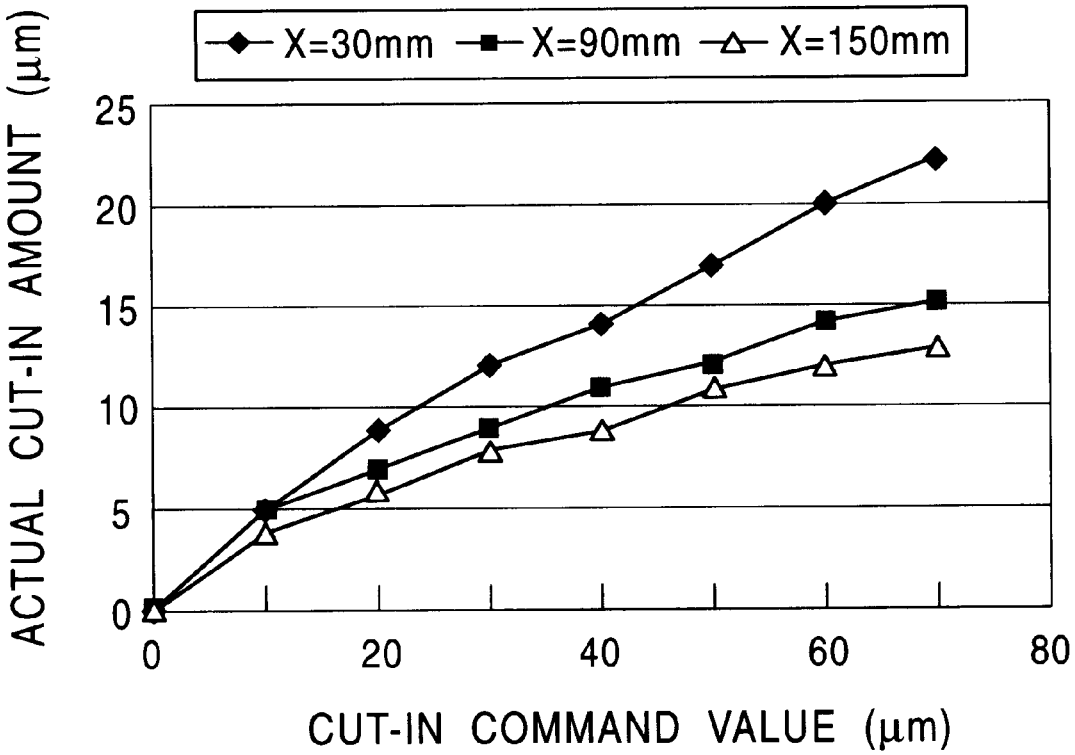
FIG. 15 is a chart designating the relationship between the CUT-IN command value and the actually cut value.

In the measuring process, 0–70 $\mu$m of the CUT-IN value was input. In order to measure difference caused by difference of background-color areas, actual position of the wafer was measured at the width center of a whetstone at 30 mm, 90 mm, and 150 mm of intervals. FIG. 15 designates the measured result.

As shown in FIG. 15, due to difference of contact areas, the whetstone thrust amount varied.

As is apparent from FIG. 15, the whetstone is strongly thrust in such a portion having a small contact area. Deforming amount of the whetstone decreases relative to the increase of contact area. Because of this, even when an identical CUT-IN command value is input, a total sum of reaction force along external circumference is less than that of the center portion, and thus, it is presumed that superficial pressure of the wafer is partially raised by deformation of the whetstone. It is probable that the superficially raised pressure causes stepwise difference relaxing capability to be lowered along external circumference of the wafer.

D-2: Process with a Tilt of the Main Shaft of 13 $\mu$m and a Constant Forwarding Velocity of F100

In the course of processing a wafer comprising thermally oxidized film by applying a constant CUT-IN rate and a constant forwarding velocity to execute a CUT-IN process per constant length, a comparative evaluation was effected between the actually processed result and the simulated result. In this experiment, the CUT-IN rate varied as shown in FIG. 15 against the actually commanded value. However, for the convenience sake, the CUT-IN rate was computed by way of applying the representative values shown below.

| Command value | Computed CUT-IN rate |
|---|---|
| CUT-IN by 70 $\mu$m | 14 $\mu$m |
| CUT-IN by 50 $\mu$m | 12 $\mu$m |
| CUT-IN by 30 $\mu$m | 10 $\mu$m |

Inasmuch as the values shown by computation designate rates of the polishing amount at respective local points, in other words, inasmuch as the proportional constant k in the Preston's equation is not determined, actually, polishing rate was computed by way of utilizing a maximum value of the polished amount computed via an actual polishing process as a reference value.

Figure 16A:
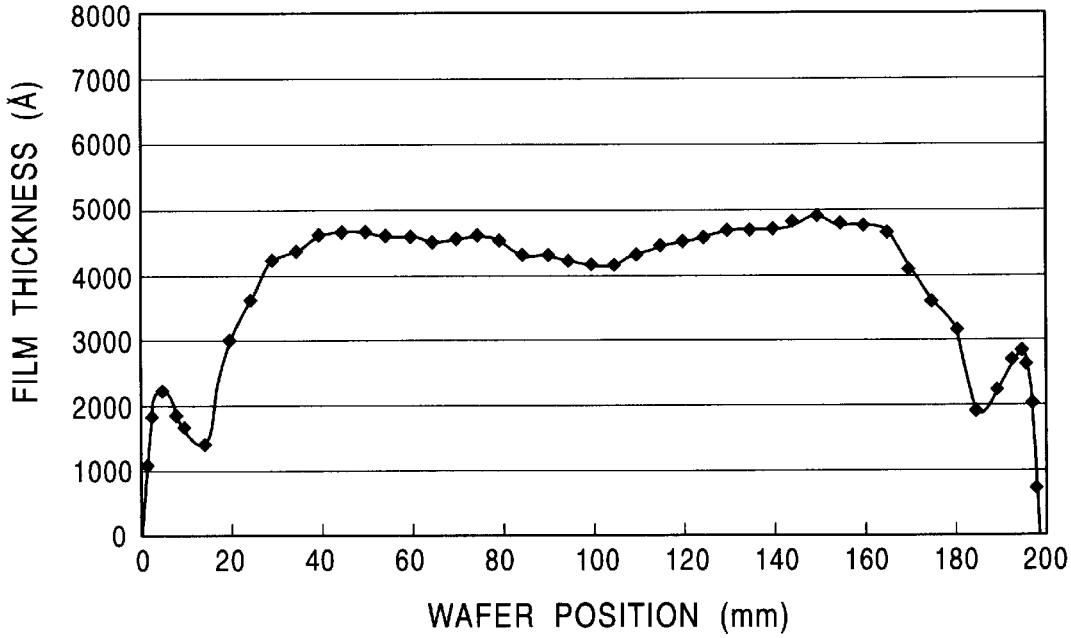
FIGS. 16A and 16B are charts designating experimental values and calculated values, respectively, of a resultant polishing rate when a maximum value of polishing amount achieved via an actual process based on 70 μm of the CUT-IN value was utilized as a reference value.
Figure 16B:
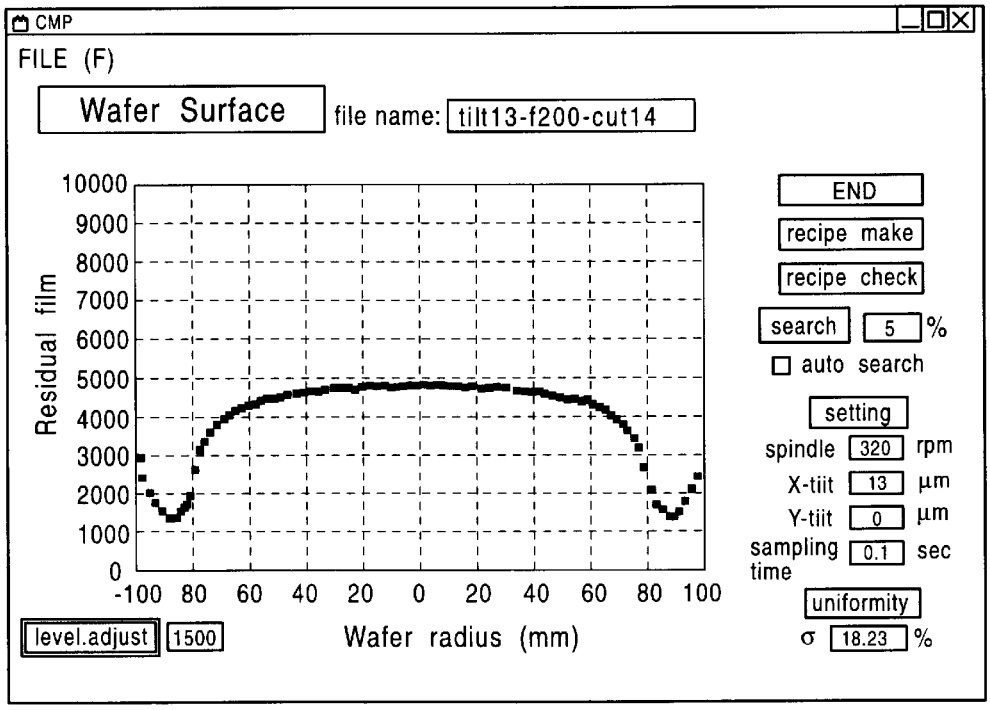

FIG. 16 designates the result of computing the polishing rate when the maximum value of the polished amount sought via an actual polishing process based on 70 $\mu$m of the commanded CUT-IN value was used as a reference value.

Figure 17A:
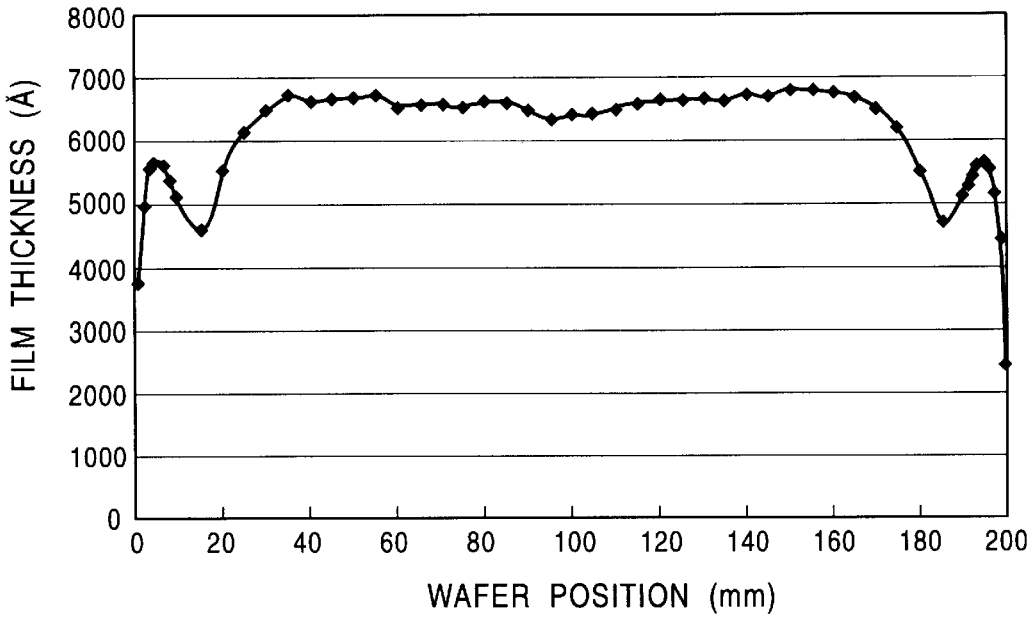
FIGS. 17A and 17B are charts designating experimental values and calculated values, respectively, of a resultant polishing rate when a maximum value of polishing amount achieved via an actual process based on 50 μm of the CUT-IN value was utilized as a reference value.
Figure 17B:
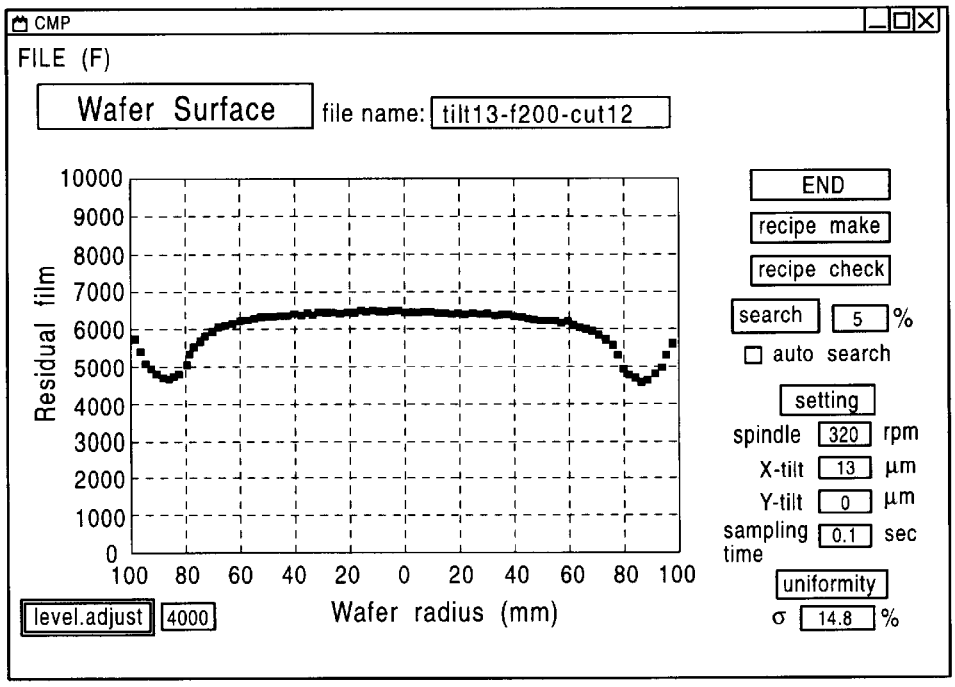

FIG. 17 designates the result of computing the polishing rate when the maximum value of the polished amount sought via an actual polishing process based on 50 $\mu$m of the commanded CUT-IN value was used as a reference value.

Figure 18A:
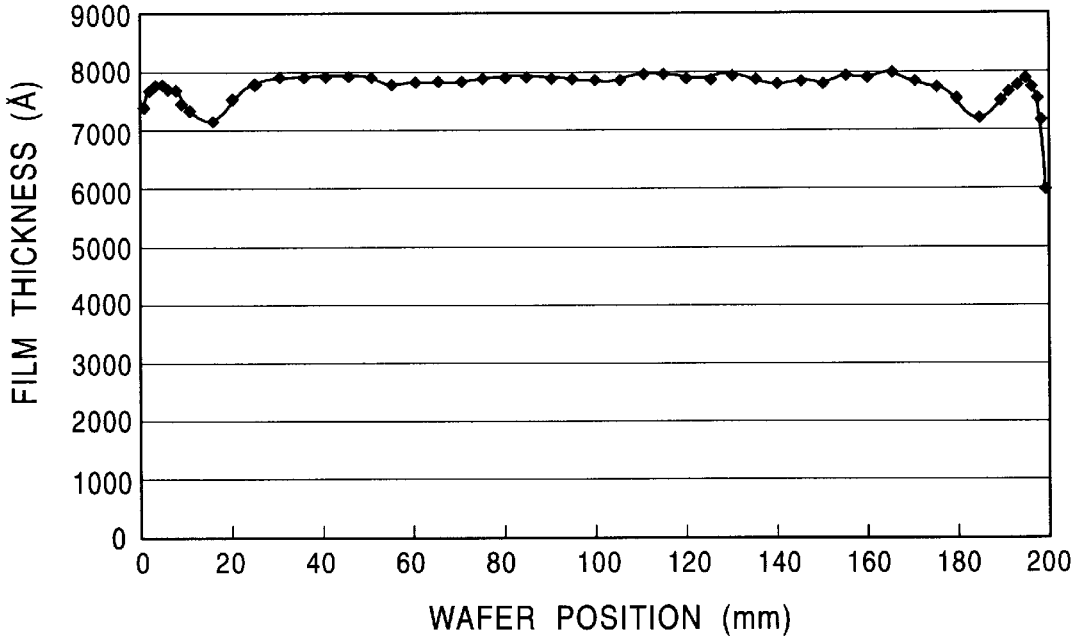
FIGS. 18A and 18B are charts designating experimental values and calculated values, respectively, of a resultant polishing rate when a maximum value of polishing amount achieved via an actual process based on 30 μm of the CUT-IN value was utilized as a reference value.
Figure 18B:
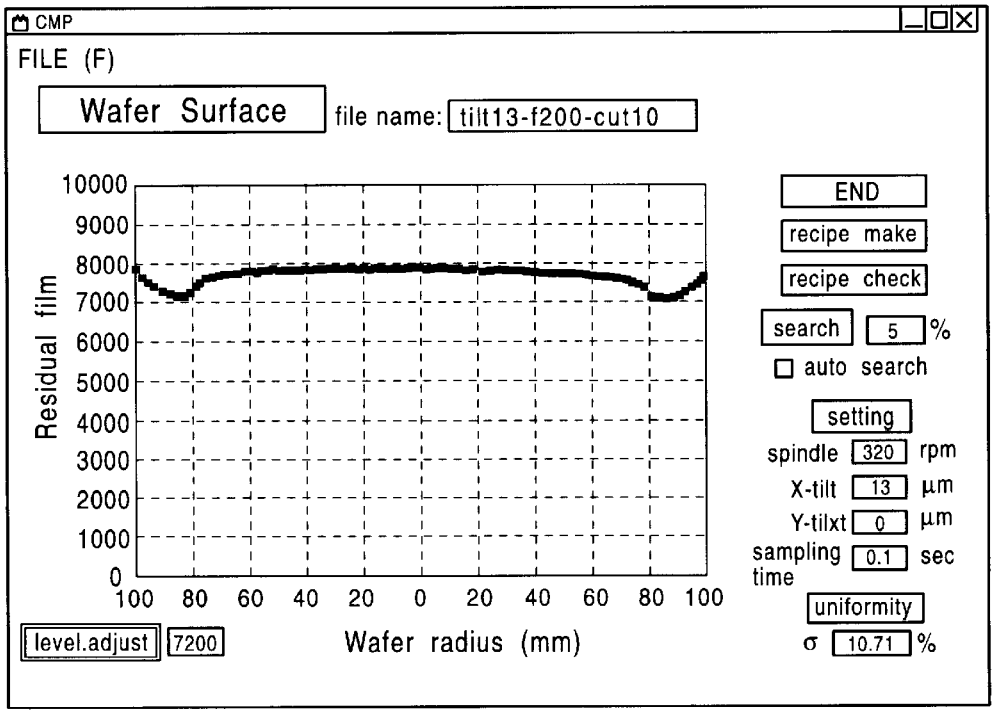
Figure 19A:
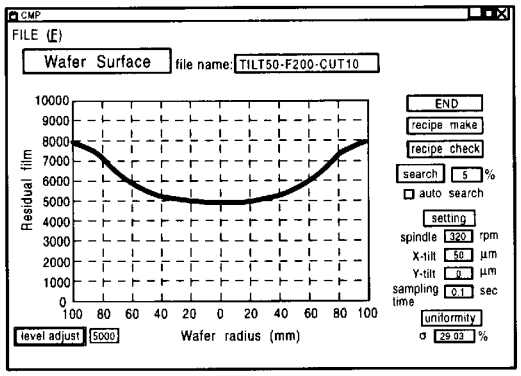
FIGS. 19A to 19F present a plurality of charts designating a removal pattern generated by way of varying tilt amount of the main shaft up to 50 μm~10 μm (19A: TILT 50 μm; 19B: TILT 40 μm; 19C: TILT 30 μm; 19D: TILT 20 μm; 19E: TILT 15 μm; and 19F: TILT 10 μm), respectively, while executing an overall polishing process at F200 of a constant feeding velocity and 10 μm of actually cut amount.
Figure 19B:
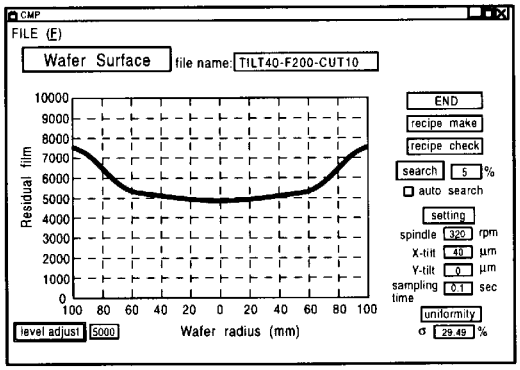
Figure 19C:
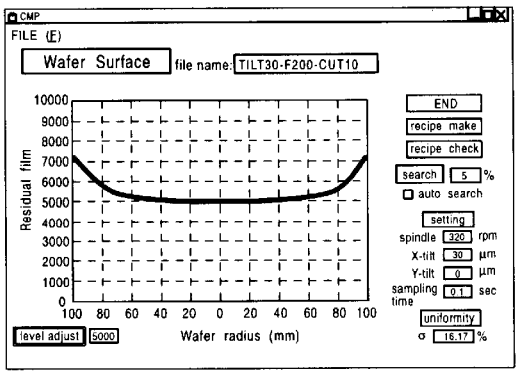
Figure 19D:
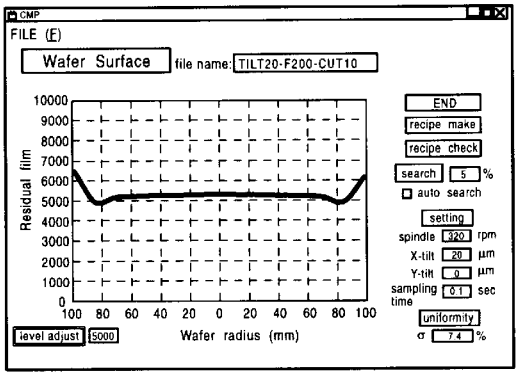
Figure 19E:
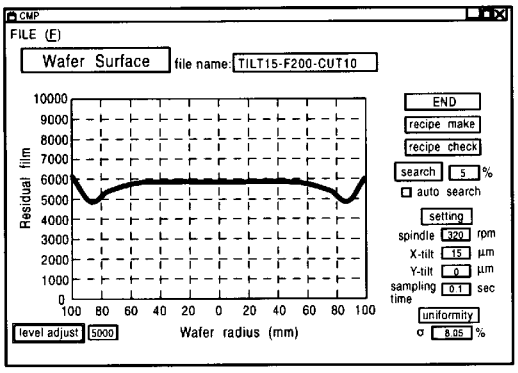
Figure 19F:
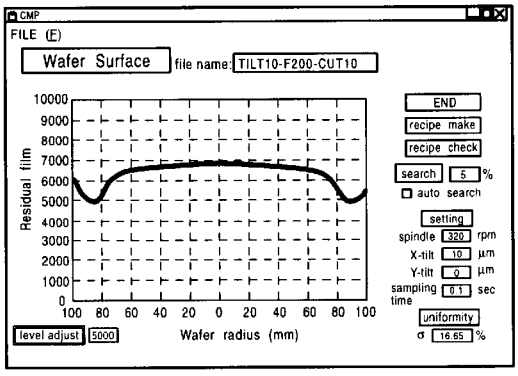

FIG. 18 designates the result of computing the polishing rate when the maximum value of the polished amount sought via an actual polishing process based on 30 $\mu$m of the commanded CUT-IN value was used as a reference value.

As shown in FIGS 16–18, except for the edge portions generating excessive polishing effect, results of computation proved to be very close to the values generated via experiments.

E: Results from Various Studies

Except for the edge portions, after confirming that the computed results were substantially coincident with the experimented values, various studies were implemented via computation. Details are described below.

E-1: Possibility on the Polishing Process with a Constant Forwarding Velocity by Utilizing a Large-diametric Wheel Based on such an understanding that uniformity can be secured by way of polishing a wafer at a constant velocity via such a wheel with a diameter greater than that of the wafer, various experiments and studies have been underway. This is exemplified by the following studies.

FIG. 19 designates removable pattern when varying tilt amount of the main shaft up to 50 μm~10 μm in the course of polishing whole surface of a wafer under a constant forwarding velocity of F200 and an actual CUT-IN rate of 10 μm.

As is clear from FIG. 19, even when an identical recipe is input thenceforth, removable pattern generated by the tilt amount of the main shaft significantly varies. The steeper the tilt, the greater the removable amount at the center portion. On the other hand, as the tilt decreases, removable amount along external circumference increases.

Such a removable pattern generated by 20 μm of the tilt amount deserves attention. Actually, the removable pattern within 160 mm of diameter was substantially uniformly removed. This in turn infers that, in a case of removing pattern from a 6-inch wafer, uniformity can be secured by fixing the tilt amount of the main shaft at approximately 20 μm and forwarding the main shaft with a constant velocity. Based on an actual computation, surface of the wafer is fully leveled off when securing an actual CUT-IN rate of 10 μm, a constant forwarding velocity of F200, and a tilt amount of the main shaft of 23 μm.

Figure 20B:
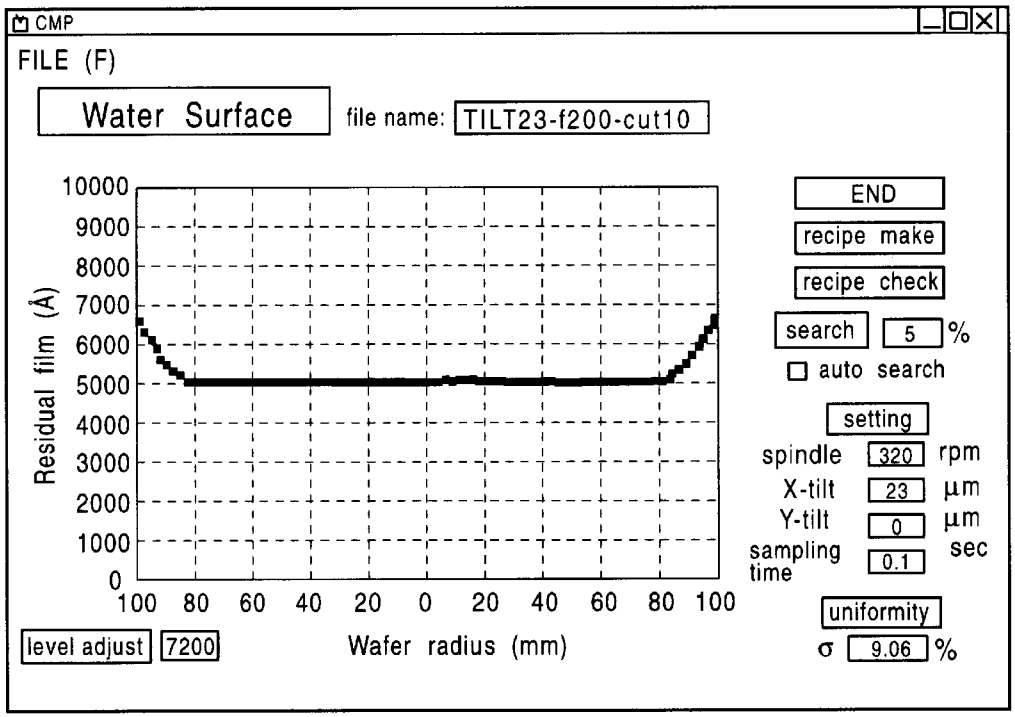
FIG. 20A presents an explanatory view of a processing utilizing a large diametric wheel and FIG. 20B is a chart showing calculated values of an overall processing at a tilt amount of 23 μm, an actual CUT-IN value of 10 μm and a constant feeding velocity of F200.
Figure 20A:
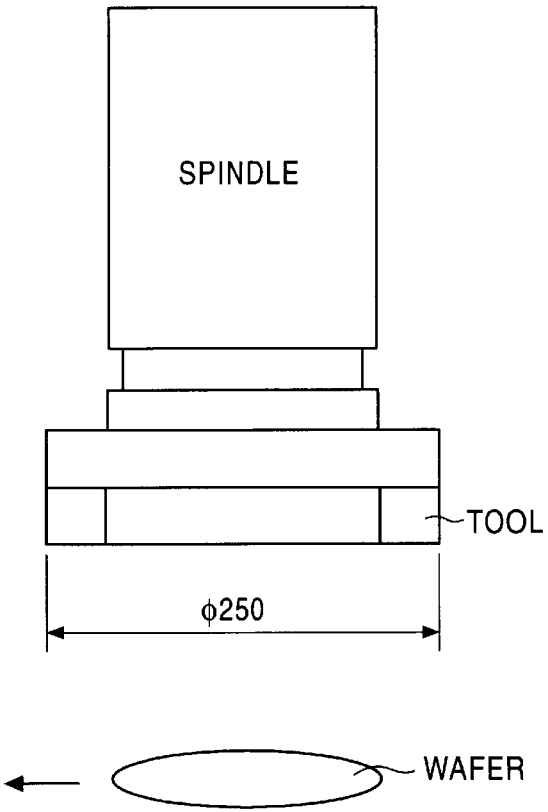
Figure 21A:
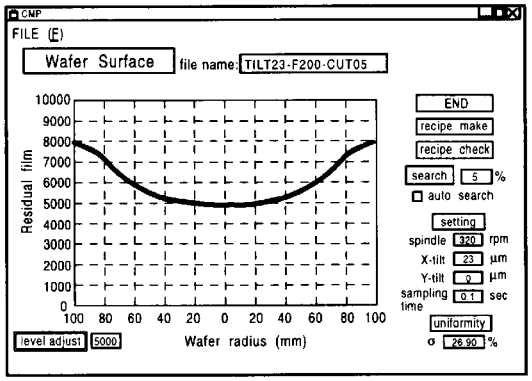
FIGS. 21A to 21F present a plurality of diagrams for explanatory of dependence on the CUT-IN effect while executing an overall process by applying a constant tilt amount of the main shaft of 23 μm and a constant feeding velocity of F200 (21A: CUT IN 5 μm; 21B: CUT IN 8 μm; 21C: CUT IN 10 μm; 21D: CUT IN 12 μm; 21E: CUT IN 15 μm; and 21F: CUT IN 20 μm).
Figure 21D:
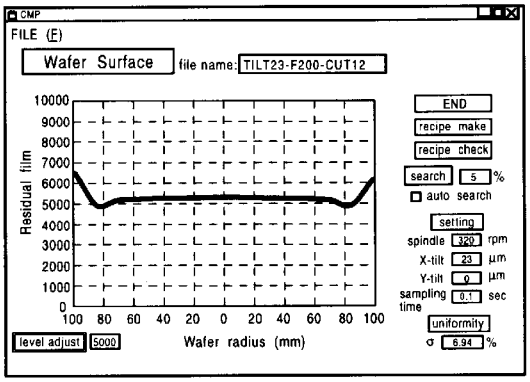
Figure 21B:
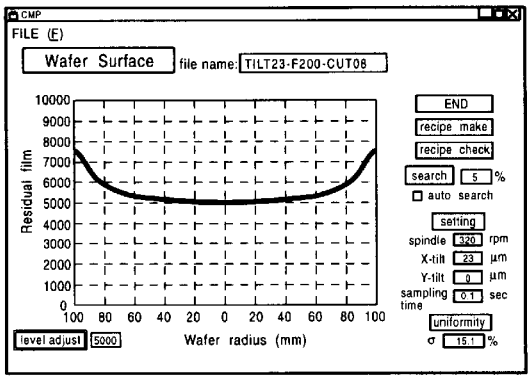
Figure 21E:
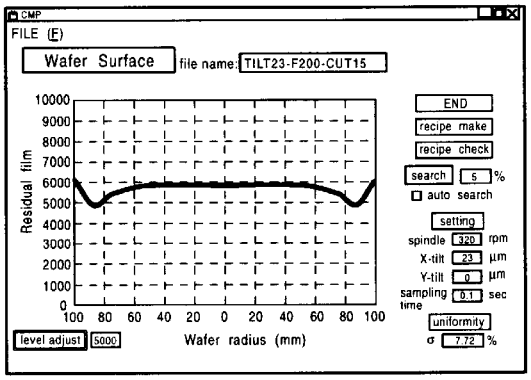
Figure 21C:
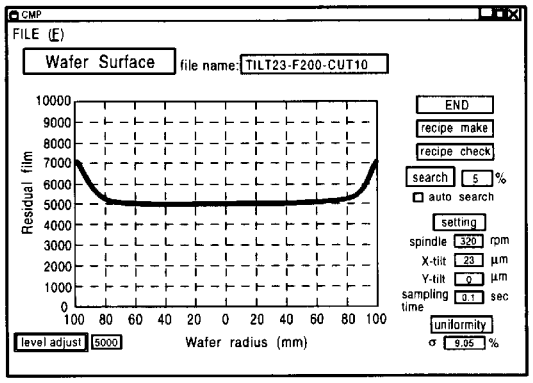
Figure 21F:
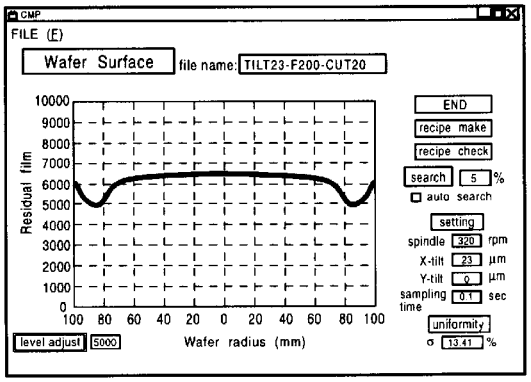

When processing an 8-inch wafer, as shown in FIG. 20, by way of utilizing such a wheel having approximately 250 mm of outer diameter, basically, uniformity could be secured by a constant forwarding velocity without precisely setting recipe.

Nevertheless, as shown in FIG. 21, when varying the CUT-IN value, form of so-called "contact area pattern" also varies to lead to failure to secure uniformity while processing the wafer with a large-diametric wheel with a constant velocity. In order to prevent this, it is necessary to fix the uniformity level at a certain degree.

E-2: Relationship between the Form of "Contact Area Pattern" and Tilt of the Main Shaft A slit with a predetermined form is provided for a surface portion of a wheel to be abutted with a wafer.

Figure 22:
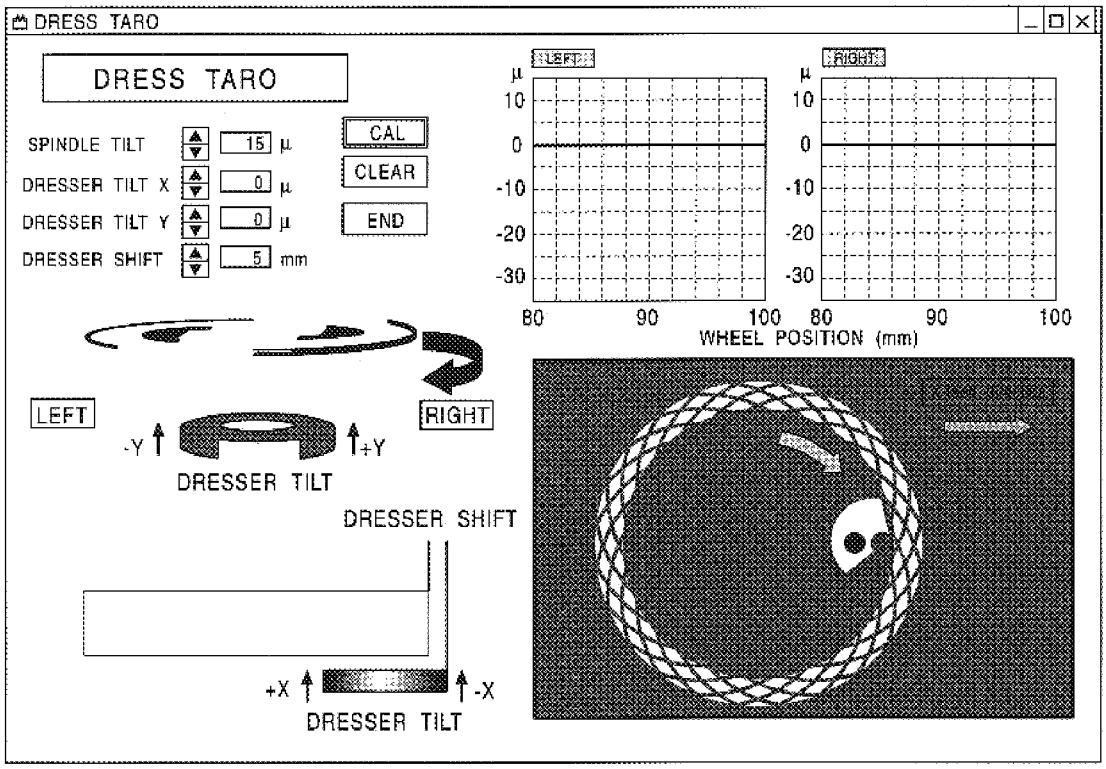
FIG. 22 presents a schematic chart for explanatory of meshed slits formed on a contact surface abutted with a wafer at the wheel portion.
Figure 23:
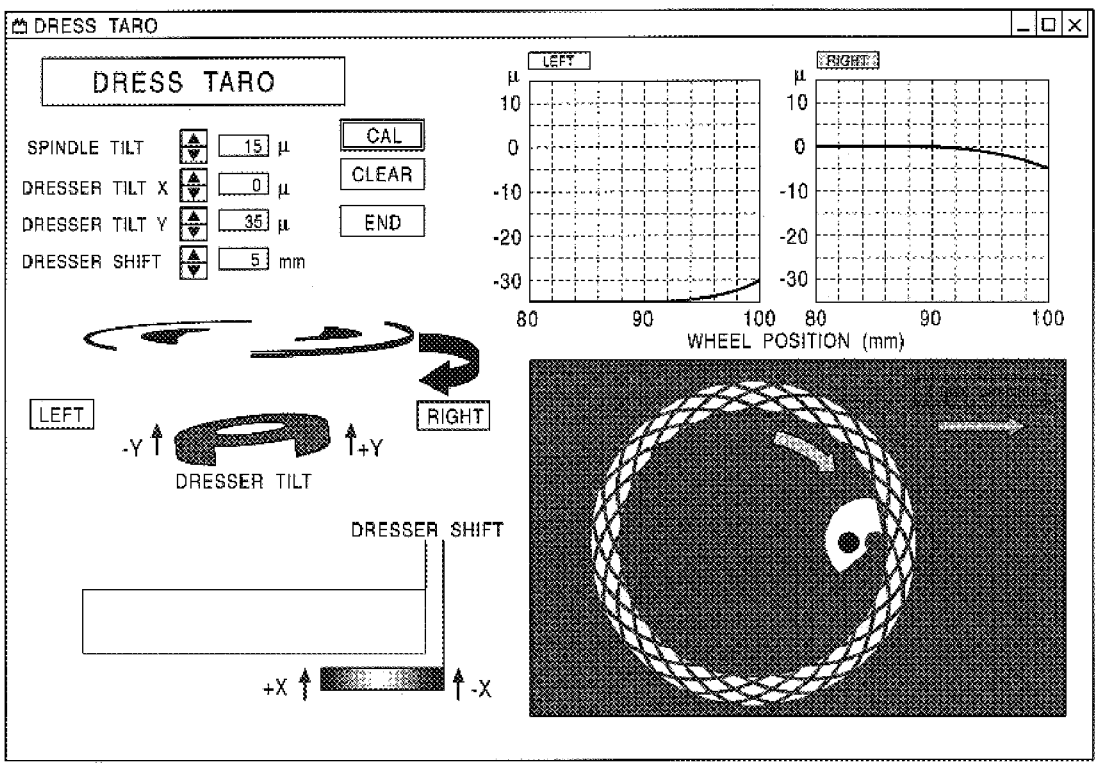
FIG. 23 presents a schematic chart for explanatory of slurry-blowing slits formed on the contact surface abutted with a wafer at the wheel portion.
Figure 24:
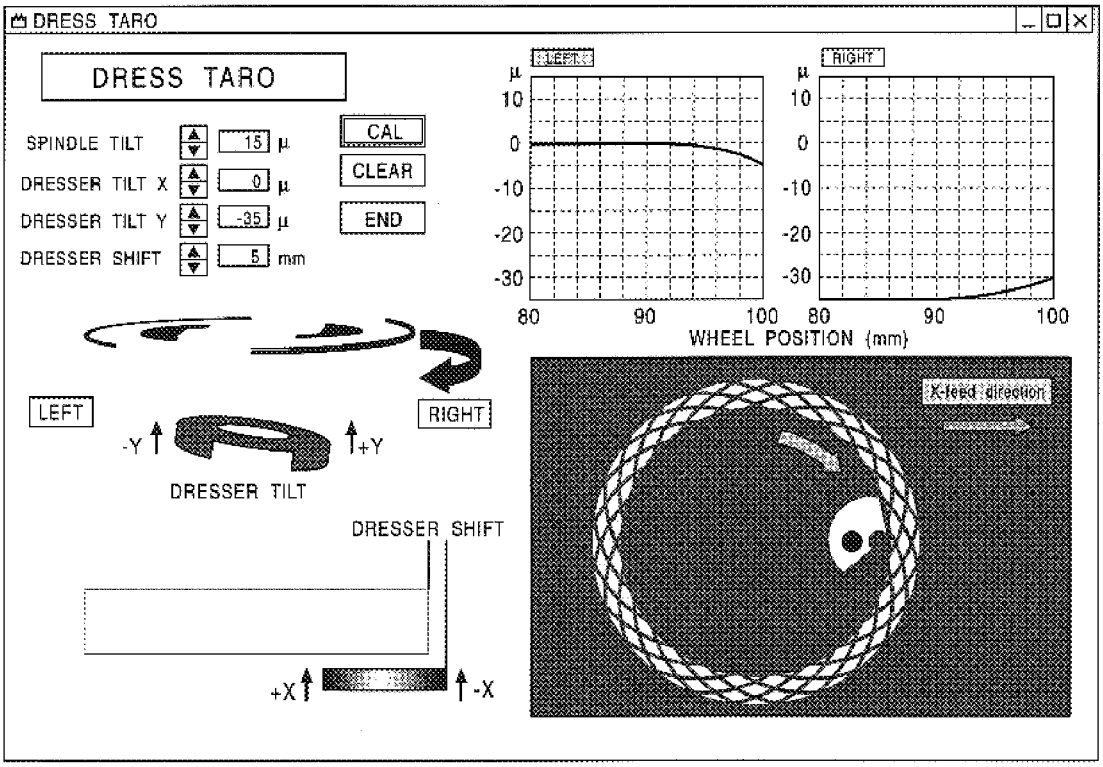
FIG. 24 presents another schematic chart for explanatory of slurry-absorbing slits formed on the contact surface abutted with a wafer at the wheel portion.

Concretely, meshed slits as the one shown in FIG. 22, or a slurry-blowing slit as the one shown in FIG. 23, or a slurry-absorbing slit as the one shown in FIG. 24 are formed.

In this embodiment, a slurry-absorbing slit as shown in FIG. 24 is provided, for example.

Figure 25:
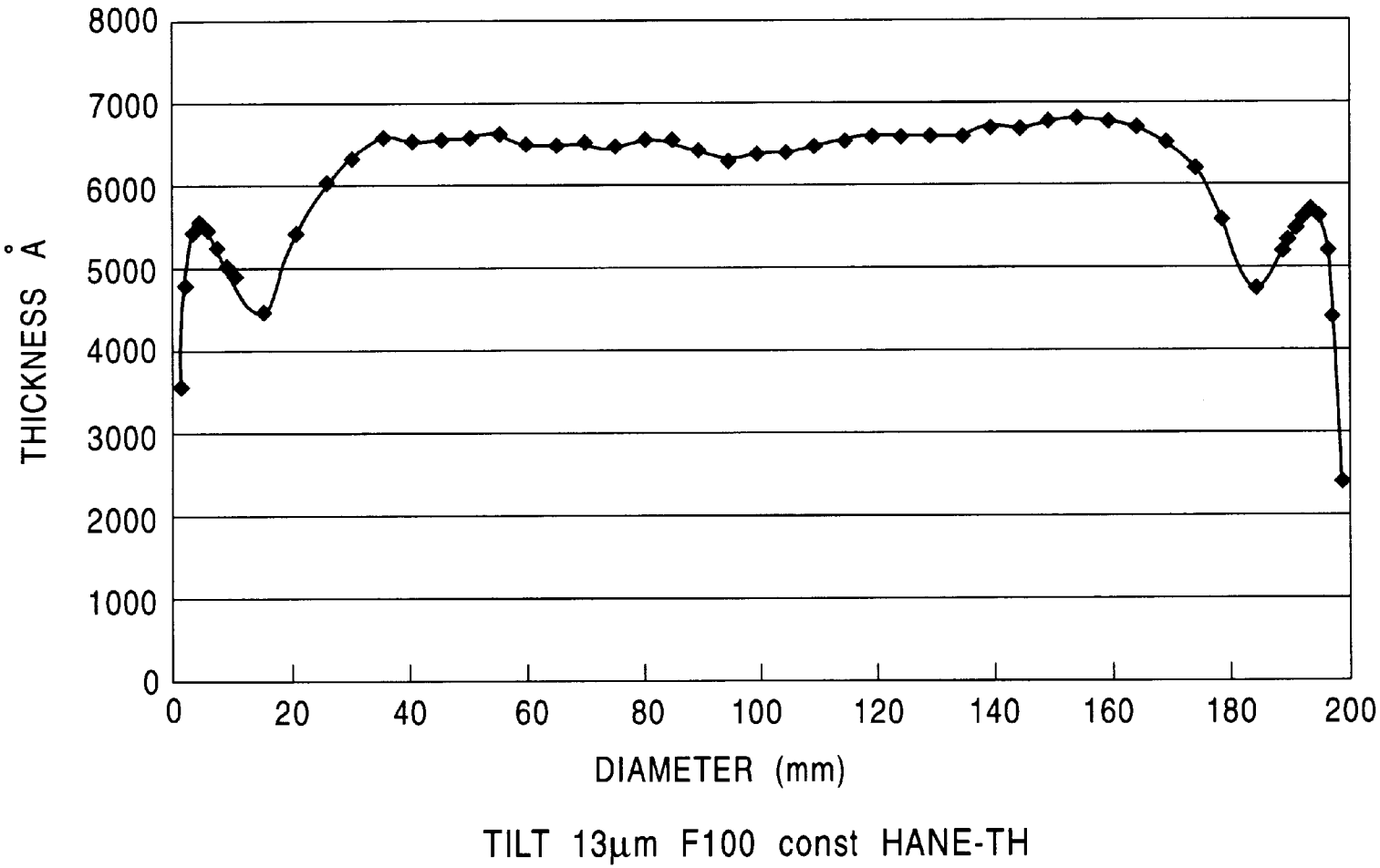
FIG. 25 is a chart designating a pattern of a remaining film when utilizing the meshed slits and 13 μm of the tilt amount of the main shaft.
Figure 26:
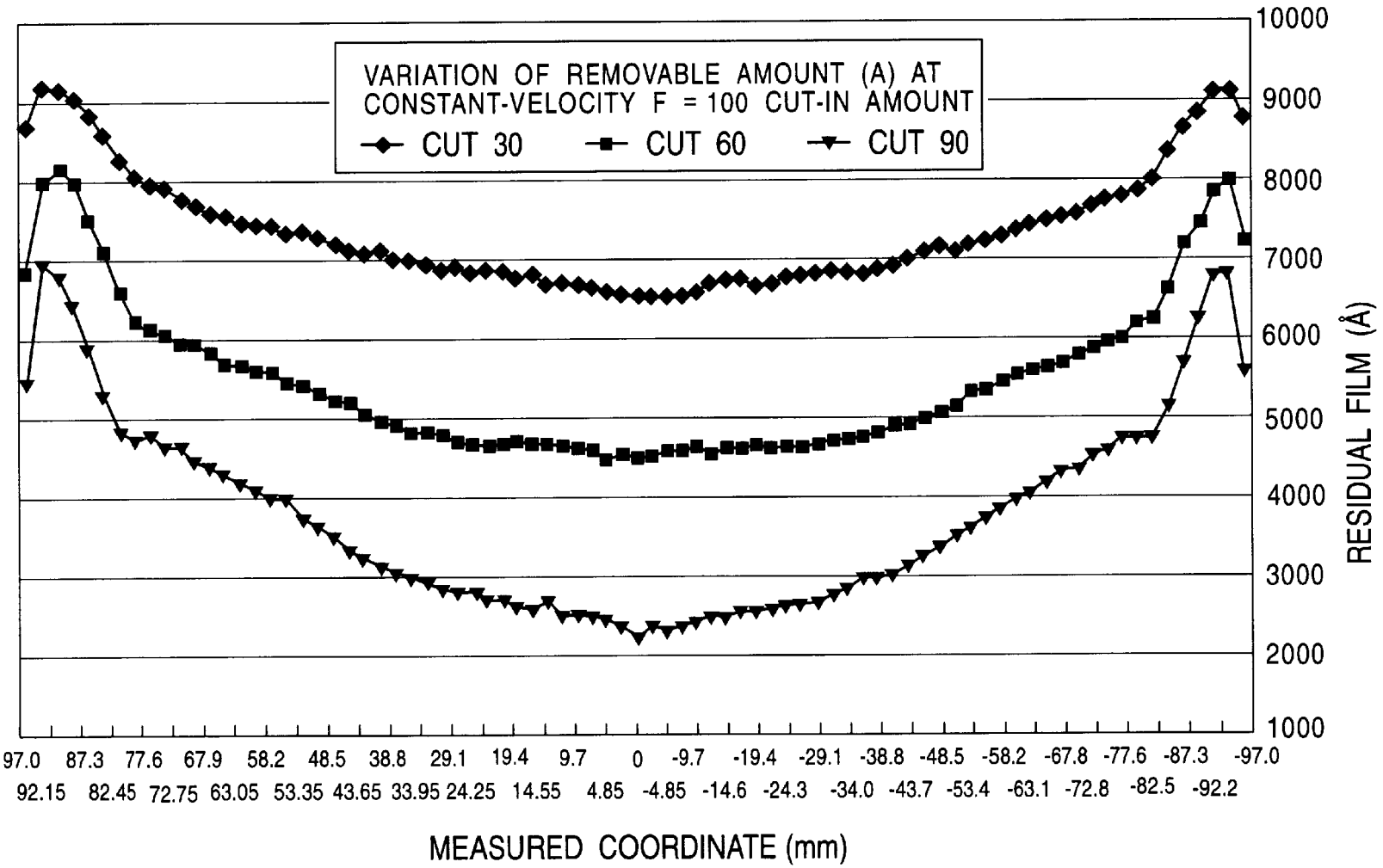
FIG. 26 is a chart designating a pattern of a remaining film when the utilizing meshed slits and 50 μm of the tilt amount of the main shaft.
Figure 27:
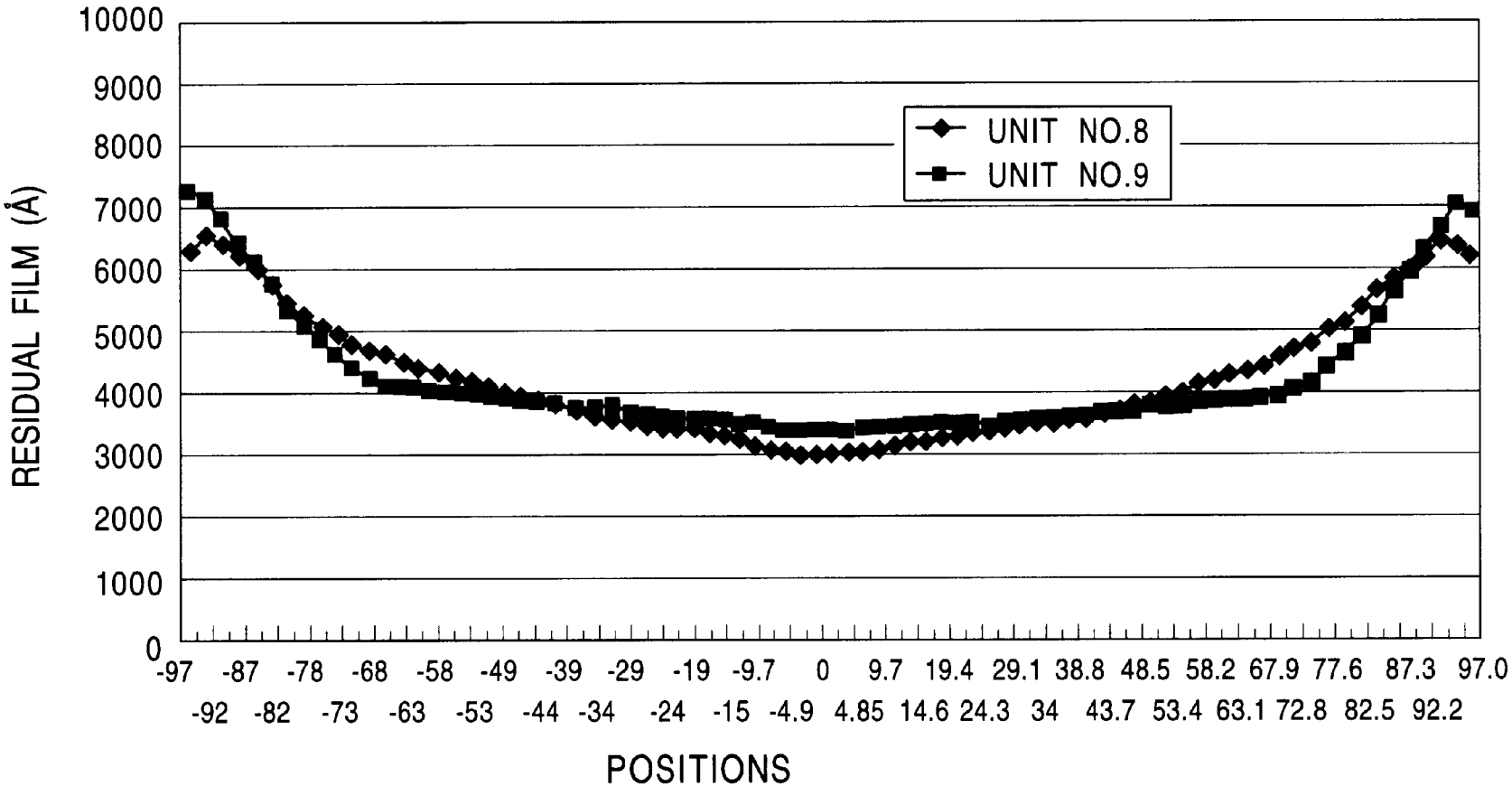
FIG. 27 is a chart designating a pattern of a remaining film when utilizing absorptive-form slits and 13 μm of the tilt amount of the main shaft.
Figure 28A:
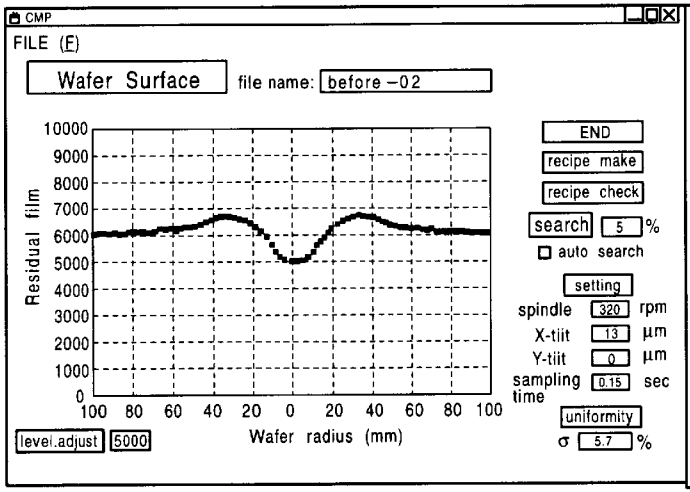
FIGS. 28A to 28D are explanatory views of an automatic recipe detecting function (28A: removal pattern before correction; 18B: removal pattern after correction; 28C: recipe before correction; and 18D recipe after correction)
Figure 28B:
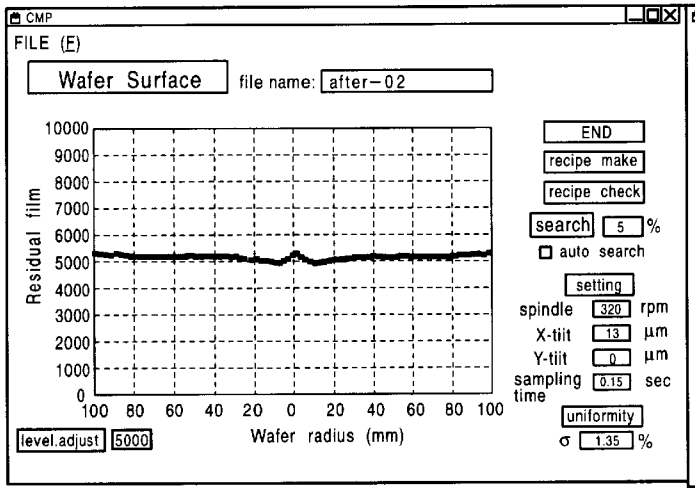
Figure 28C:
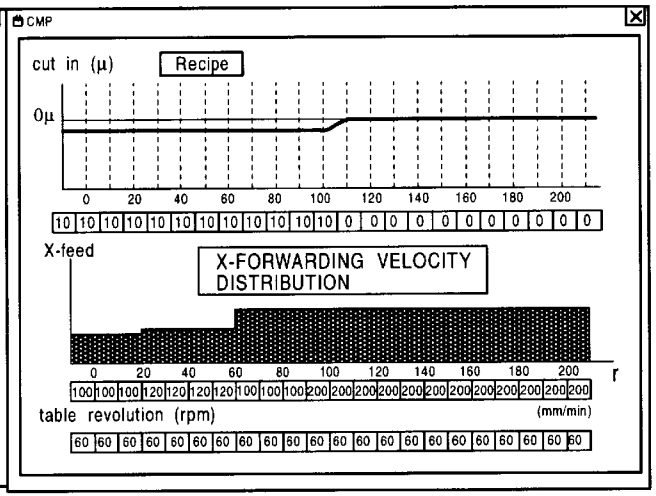
Figure 28D:
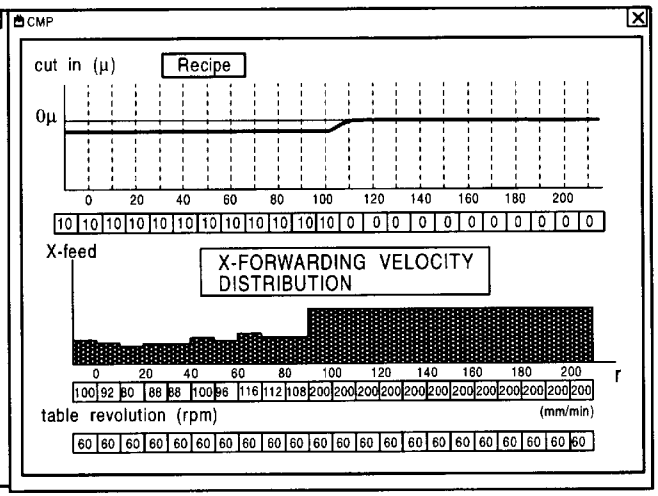

FIG. 25 designates remaining film pattern when the surface-contact portion is provided with meshed slits and the main shaft is tilted by 13 μm. FIG. 26 designates another remaining film pattern when the surface-contact portion is provided with meshed slits and the main shaft is tilted by 50 μm. FIG. 27 designates another remaining film pattern when the surface-contact portion is provided with slurry-absorbing slits and the main shaft is tilted by 13 μm.

As shown in FIG. 25, when meshed slits are provided and the main shaft is tilted by 13 μm, satisfactory pattern of the remaining film is generated. As shown in FIG. 26, when meshed slits are provided and the main shaft is tilted by 50 μm, such a remaining film pattern With the recessed center portion is generated.

On the other hand, in the case of slurry-absorbing slits, despite of a slight tilt of the main shaft, such a remaining pattern similar to the one generated in the case of meshed slit and a substantial tilt of the main shaft can also be secured.

Because of the above results, when introducing the one with slurry-absorbing slit as provided for this embodiment, by way of further contracting the tilt angle of the main shaft, it is presumably possible to secure such a satisfactory remaining film pattern as the one shown in FIG. 25.

Although not shown in the drawings, when utilizing slurry-blowing slits, inverse from the slurry-absorbing slits, such a remaining film pattern with projected center portion is generated.

Accordingly, when utilizing the slurry-blowing slits, by way of increasing tilt angle of the main shaft, such a satisfactory remaining film pattern as the one shown in FIG. 25 can be secured.

As mentioned above, by way of properly selecting tilt angle of the main shaft in correspondence with the slit form, it is possible to secure satisfactory remaining film pattern.

Conversely, when the tilt angle of the main shaft is fixed, by way of selecting a proper slit form compatible with the tilt, it is also possible to secure satisfactory remaining film pattern.

E-3: Automatic Recipe Searching Function

The one-dimensional simulation software incorporates such a function for automatically computing a proper recipe capable of securing uniformity by way of varying velocity for forwarding X-axis on a personal computer from a polishing pattern generated from a certain recipe.

Actual condition is shown in FIG. 28. It is inferred from FIG. 28 that, based on arithmetic assumption, by quantifying difference from an actual value, any recipe can roughly be adjusted in correspondence with a variety of processing conditions especially when varying tilt angle of the main shaft.

Further, it is necessary to properly adjust any recipe when compatibility with polishing effect differs within surface of a wafer due to uneven film quality. In this case, by way of computing compatibility with polishing effect at local points on the surface of a wafer in comparison to theoretical values followed by automatic computation of a certain recipe added with the result of comparative evaluation, it is possible to simplify correction of the uniformity.

A polishing status measuring unit 300 is provided, which comprises a detecting device 180 and a controller 190 electrically connected to the detecting device 180.

The detecting apparatus 180 detects variation of reflectivity on the surface of a wafer 101, which comprises a light receiving/emitting unit 181 and an optical fiber 182 connected to the light receiving/emitting unit 181.

The light receiving/emitting unit 181 converts a drive signal received from the controller 190 into specific light corresponding to the magnitude of the drive signal to enable emitted light to be transmitted through the optical fiber 182, and then, further converts the light transmitted through the optical fiber 182 into a sensor signal corresponding to intensity of the light before transmitting it to the controller 190. In this case, such a light emitting diode (LED) emitting 390 nm of wavelength and a photo-sensor incorporating a photo-detector and an analog output terminal are respectively used.

The optical fiber 182 comprises double cores. Tip of the optical fiber 182 is at a position abutted with the processing head 160, and yet, being secured in the direction of the surface of a wafer 101 at a height position 50 nm–100 nm upper than the X-directional center line of the wafer 101, for example.

Based on the value detected by the detecting device 180, the controller 190 identifies remaining unscraped portion of the wafer 101, and then, automatically generates a polishing condition for the remaining unscraped portion and the portion other than the remaining unscraped portion before feeding it back to the controller 190 itself.

Figure 29:
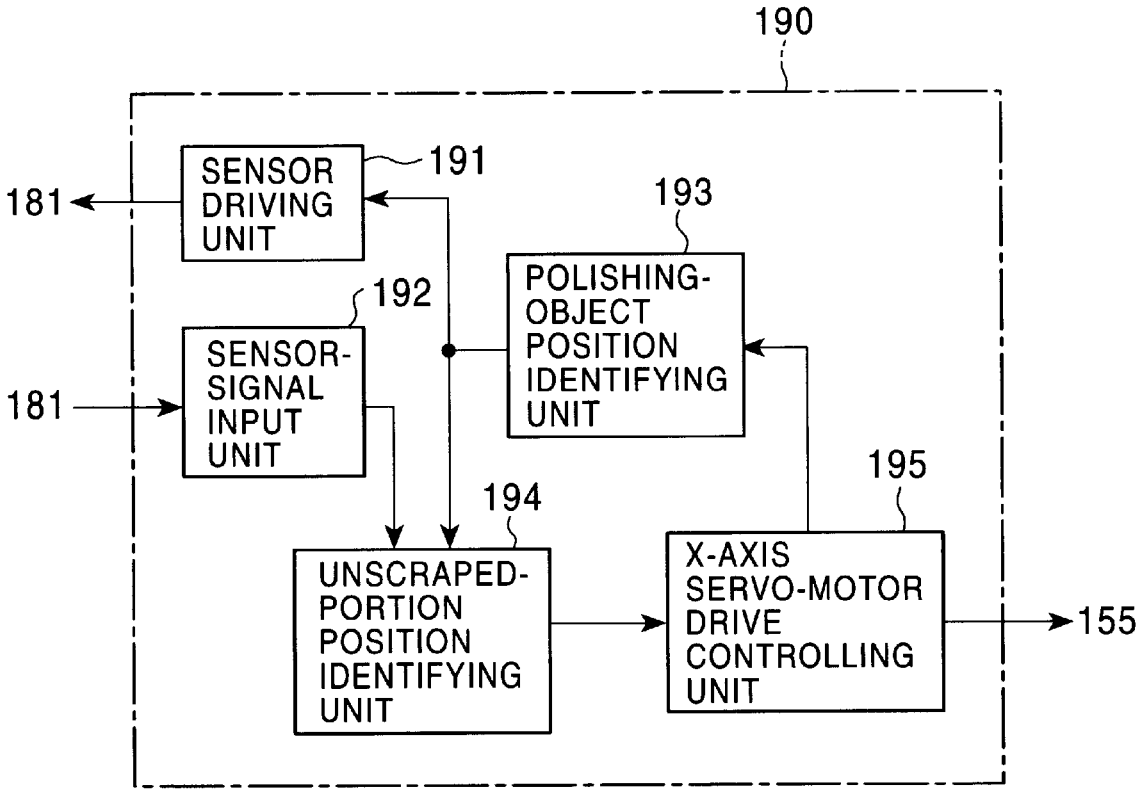
FIG. 29 is a schematic block diagram of a controlling unit for controlling operation of a polishing status measuring unit.

FIG. 29 is a schematic block diagram designating structural detail of the controller 190. The controller comprises a sensor driving unit 191, a sensor-signal input unit 192, a polishing-object position identifying unit 193, an unscraped portion position identifying unit 194, and an X-axis servo-motor drive controlling unit 195.

The sensor driving unit 191 and the sensor-signal input unit 192 are electrically connected to the light receiving/emitting unit 181. The sensor driving unit 191 is also electrically connected to the polishing-object position identifying unit 193. The sensor signal input unit 192 is also electrically connected to the unscraped portion position identifying unit 194. The polishing-object position identifying unit 193, the unscraped portion position identifying unit 194, and the X-axis servo-motor drive controlling unit 195 are mutually linked with each other via loop. The X-axis servo-motor drive controller 195 is electrically connected to the X-axis servo motor 155.

Acting on the position signal of the wafer 101 on the X-axis delivered from the polishing object position identifying unit 193, the sensor driving unit 191 having such a configuration as described above outputs a predetermined drive signal to the light receiving/emitting unit 181. On receipt of a sensor signal from the light receiving/emitting unit 181. the sensor-signal input unit 192 outputs this signal to the unscraped portion position identifying unit 194. On the other hand, based on the drive signal from the X-axis servo-motor drive controlling unit 195, the polishing object identifying unit 193 identifies the X-axial position of the wafer 101 and then outputs the identified signal to the sensor driving unit 191 and the unscraped portion position identifying unit 194.

Based on the sensor signal from the sensor signal input unit 192 and the X-axial positional signal of the wafer 101 from the polishing object position identifying unit 193, the unscraped portion position identifying unit 194 identifies the X-axial position of the unscraped portion on the surface of the wafer 101 and then outputs the identified signal to the X-axis servo-motor drive controlling unit 195. Based on the X-axial position signal of the unscraped portion on the surface of the wafer 101 delivered from the unscraped portion position identifying unit 194, the X-axis servo-motor drive controlling unit 195 controls the driving of the X-axis servo motor 155.

Because of the above arrangement, immediately after completing a polishing process via the processing head 160, it is possible for the polishing-status measuring unit 300 to execute a measuring process against the wafer 101 secured to the processing table 150 merely by way of driving the processing table 150.

Next, the relationship between the superficial reflectivity of the wafer 101 and the polishing condition (in terms of the unscraped remaining portion and such portion other than the unscraped remaining portion) is described below.

Figure 30:
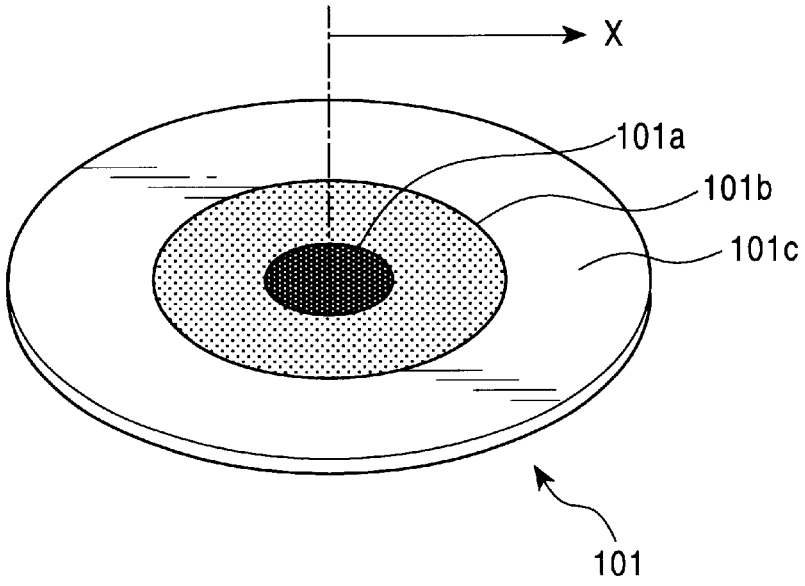
FIG. 30 is a perspective view of an example of the surface condition of a wafer after being polished.

FIG. 30 is a perspective view showing an example of the surface condition of the wafer 101 completed with a polishing process.

Since the wafer 101 is polished by the rotary processing head 160 while being rotated by the processing table 150, as shown in FIG. 30, such a portion 101*c* other than an unscraped remaining portion 101*a* of a copper (Cu) film used for forming multi-layer wiring pattern, another unscraped remaining portion 101*b* of a barrier film made of tantalum (Ta), and another unscraped remaining portion of an oxidized insulating film made of silicon dioxide ($SiO_2$), is formed into substantially a concentric-circular configuration.

Figure 31:
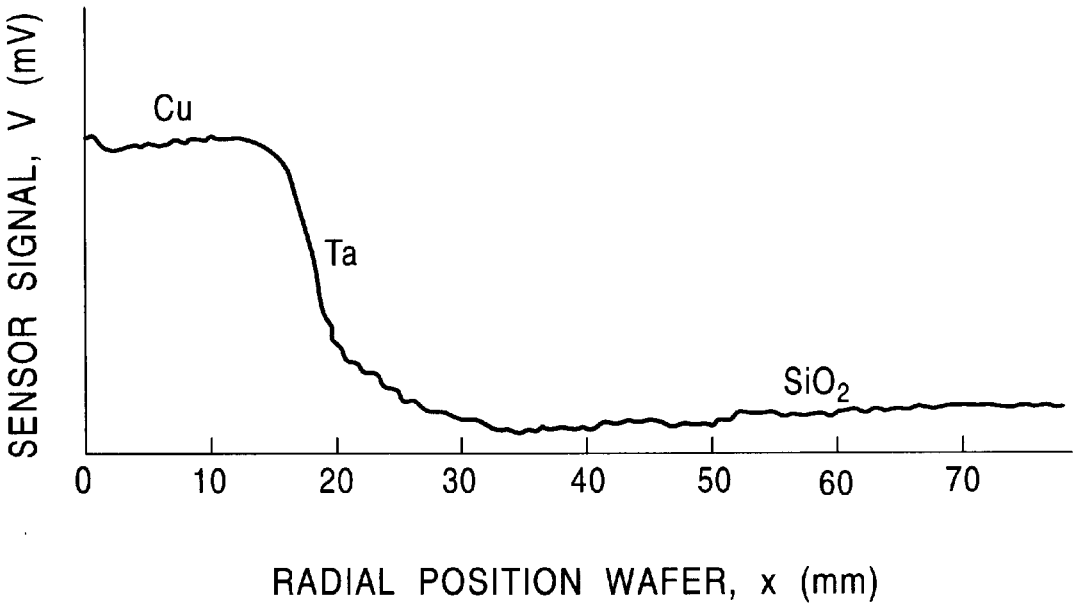
FIG. 31 is a chart designating surface reflectivity at the radial position of a wafer shown in FIG. 30.
Figure 32:
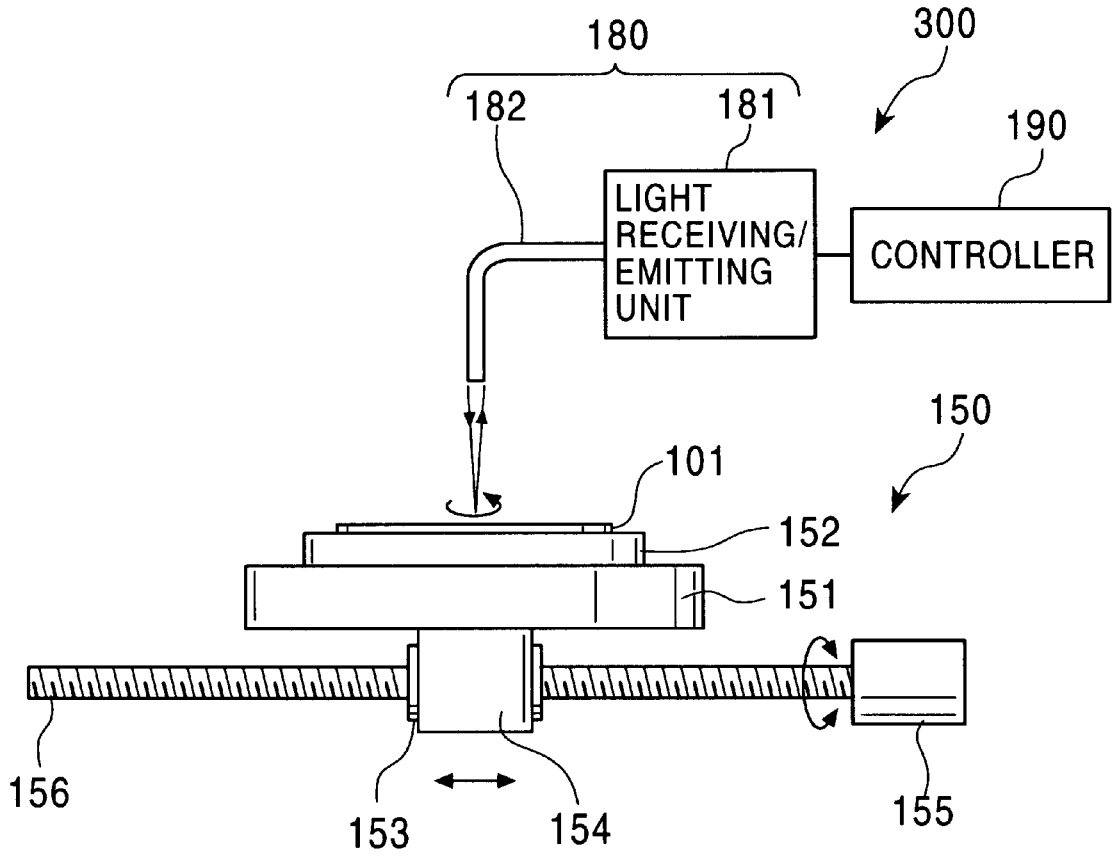
FIG. 32 is a second cross-sectional lateral view for exemplifying operation of the surface-leveling polishing apparatus shown in FIG. 1.
Figure 33:
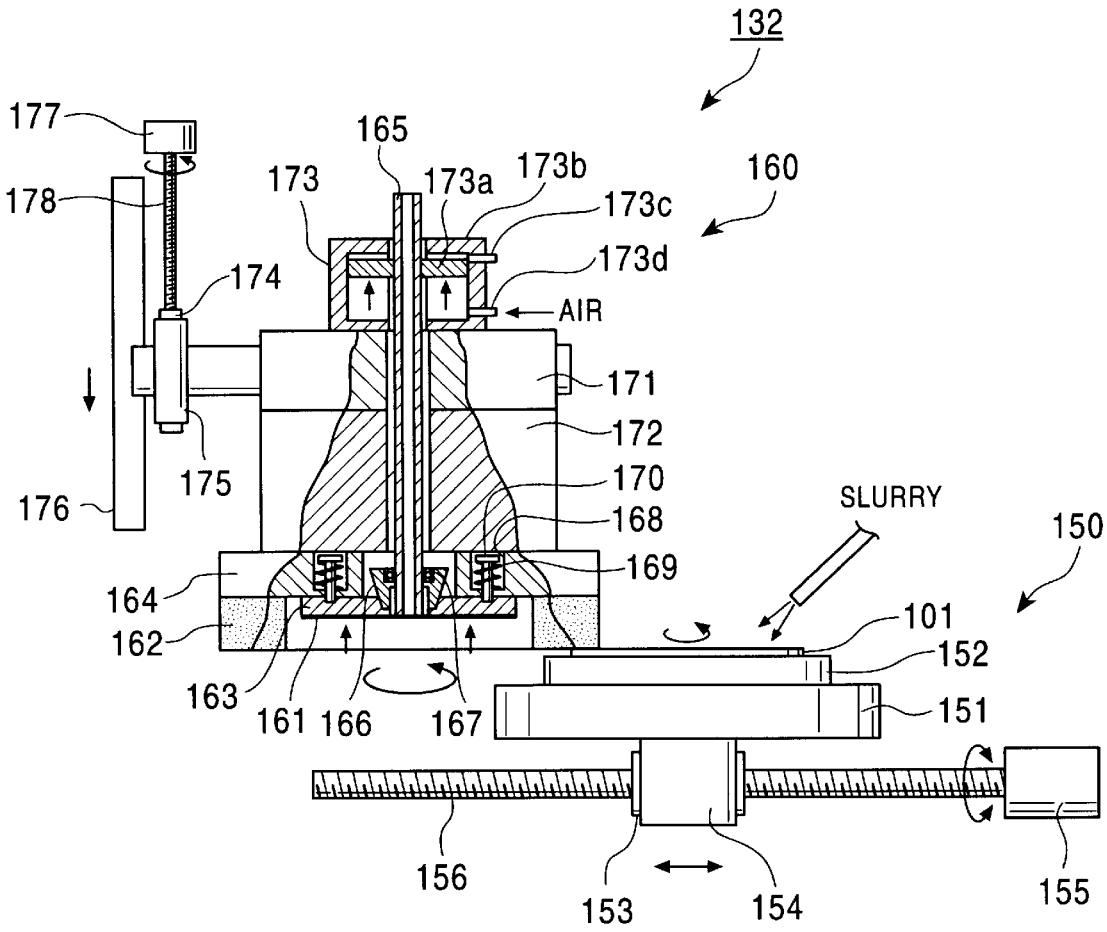
FIG. 33 is a third cross-sectional lateral view for exemplifying operation of the surface-leveling polishing apparatus shown in FIG. 1.
Figure 34:
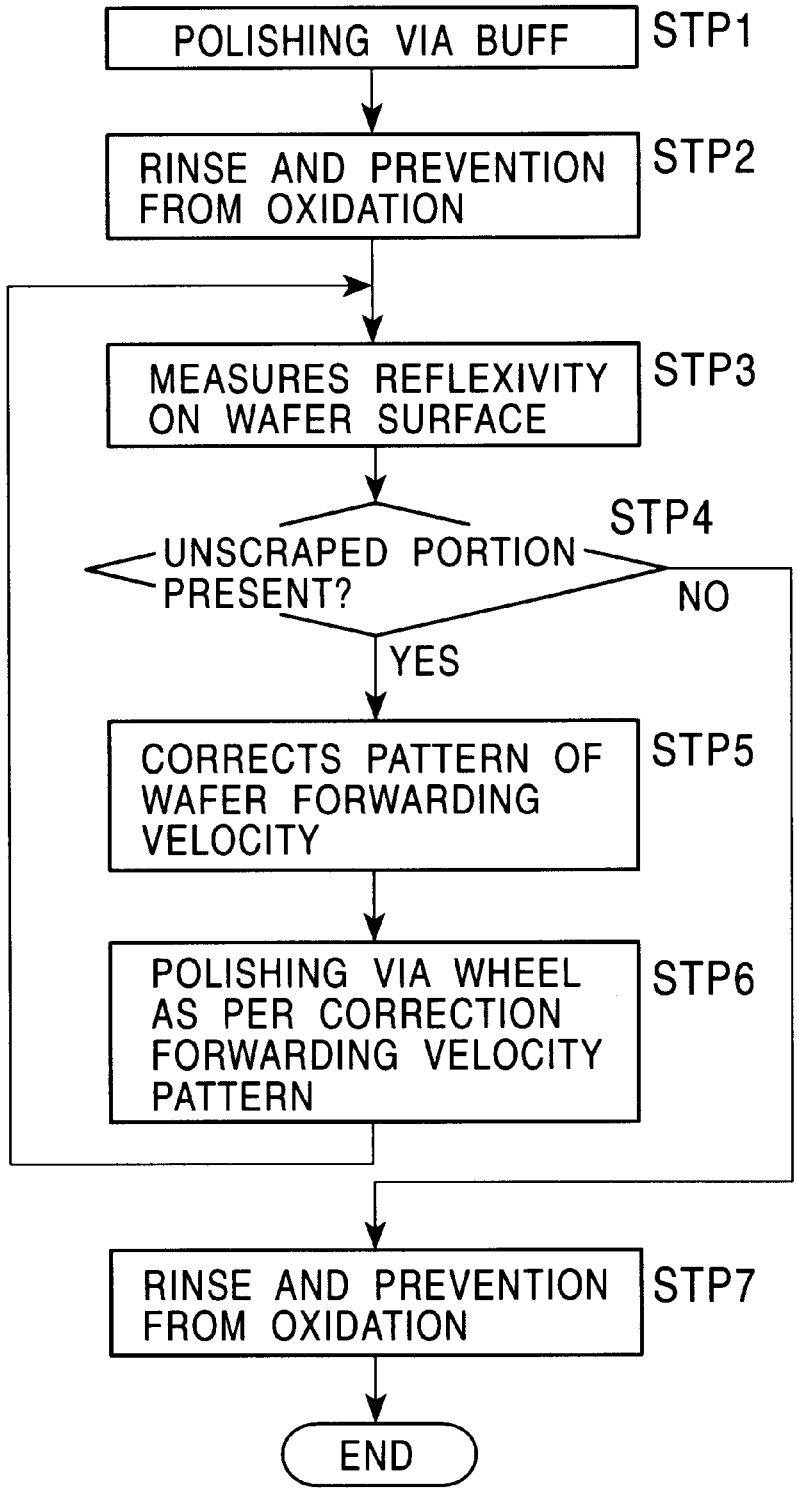
FIG. 34 is a flowchart exemplifying operation of the surface-leveling polishing apparatus related to the present invention.

Because of this, by way of measuring superficial reflectivity in the X direction from the center of the wafer 101 in the direction of outer circumference while rotating the wafer 101 with the processing table 150, it is possible to secure an averaged superficial reflectivity corresponding to the X-axial position of the wafer 101. More particularly, as shown in FIG. 31, initially, the wafer 101 is polished and then washed with pure water. Next, the wafer 101 in wet condition is rotated at 30 rpm and then shifted in the X direction to measure superficial reflectivity of the wafer 101. In FIG. 31, superficial reflectivity is designated by the sensor signal V (mV) of the light receiving/emitting unit 181. In this case, the highest reflectivity (approximately 60%–80%) is generated in a circular portion 101*a* ranging from the center (x=0 mm) up to approximately x=18 mm. The second highest reflectivity (approximately 20%–40%) is generated in an annular portion 101*b* ranging from x=18 mm up to approximately X=28 mm. The lowest reflectivity (approximately 20%–30%) is generated in another annular portion 101*c* ranging from x=28 mm up to approximately x=78 mm.

Based on the above findings, by way of measuring superficial reflectivity of the wafer 101 relative to the X-axial position of the wafer 101, it is possible to identify the actually polished condition of the wafer 101. More particularly, it is possible to identify X-axial positions of such portions in which copper film used for patterning of multi-layer wiring and barrier film made of tantalum still remain unscraped and such scraping-completed portions in which oxidized insulating film made of silicon dioxide is exposed.

Next, a method of generating the polishing condition against unscraped portion and such portion other than the unscraped portion remaining on the wafer 101 is described below.

After identifying such an X-axial position designating the wafer polishing status, the polishing apparatus reads X-directional forwarding-velocity pattern of the processing table 150, in other words, it reads forwarding velocity Fx (mm per minute) of the radial position x (mm) of the wafer 101 out from such provisional recipes constituting the past polishing condition or from recipes constituting the last polishing condition, and then, based on the identified result, override correction is implemented.

The override correction is implemented by multiplying the forwarding velocity Fx (mm/min.) of the radial position x (mm) of the wafer 101 by the excess or the shortage if the removable amount via the polishing process. For example, assume that the removable amount via the polishing process is short by 50%, then, the corrected forwarding velocity F'x (mm/min.) is increased by 0.5 times the original forwarding velocity Fx (mm/min.). Accordingly, it causes the wafer 101 to double the time to pass through the radial position x (mm), whereby causing the removable amount via the polishing process to be doubled as well.

Conversely, assume that the removable amount via the polishing process is excessive by 200%, then, corrected forwarding velocity F'x (mm/min.) doubles the original forwarding velocity Fx (mm/min.). Accordingly, the passing time of the wafer 101 through the radial position x(mm) is increased by 0.5 times, and thus the removable amount via the polishing process is also raised by 0.5 times.

In the above example, assume that total recording density of a chip is arranged to be 50%, then, such a portion showing a minimum of 60% of reflectivity (this portion corresponds to a portion of copper film 7 used for patterning of multi-layer wiring) is subject to 50% of override (doubles the removable amount via the polishing process). Such a portion showing 40%–60% of reflectivity (this portion corresponds to such a portion in which the copper film 7 used for patterning of multi-layer wiring is mixed with the barrier film 5 made of tantalum) is subject to 80% of override (1.2 times the removable amount via the polishing process). Such a portion showing a maximum of 40% of reflectivity (this portion corresponds to such a portion in which the barrier film 5 made of tantalum is mixed with oxidized insulating film made of silicon dioxide) is subject to 200% of override (0.5 times the removable amount via the polishing process) to effect the override correction.

Next, referring to FIGS. 3, 32, 33, and 34, operation of the wafer polishing apparatus comprising the above structure is described below.

When operating the wafer polishing apparatus, initially, a simulation is implemented to determine geometrical configuration of the wafer 101 and a wheel (including a buff) and also determine a theoretically countable removable amount based on Preston's polishing rule. Next, a variety of data designating variable condition of uniformity in relation to a variety of theoretically and quantitatively input parameters are input from the control panel 201 to the controller 200.

In specific, a theoretical (ideal) removable amount is computed, and then, based on a comparison with a profile when actually processing a wafer via chemical-mechanical polishing process, a proportional constant k is determined as a fixed value. Next, based on Preston's equation, polishing condition prescribed by processing pressure P, relative velocity V, and polishing time t is determined. Concretely, a proper polishing time t is determined and then delivered to the controller 200 in conjunction with other parameters. In the polishing apparatus, the main shaft is inclined in accordance with a predetermined tilt angle.

The controller 200 transmits a control signal CTL1 to the X-axis servo-motor 155 whereby controlling velocity of the wafer 101 in the X-axial direction. Another control signal CTL2 is delivered to the main-shaft spindle motor 171 to control the number of its rotation. Another control signal CTL3 is delivered to the Z-axis servo-motor 177 in order to control positioning of the processing head 160 in the Z-axial direction.

A soft buff is utilized as the buff 161. The soft buff 161 is polished with chemical solution such as etchant consisting of nitric acid, for example. A rigid wheel is utilized as the wheel 162, which consists of hard alumina grinding particles ($\gamma$-$Al_2O_3$; particle size 0.35 $\mu$m; specific gravity 1.61) respectively being fixed together. The wheel 162 is polished with slurry (pH 4.8) prepared with 10% by weight of alumina grinding particles ($Al_2O_3$; particle size 0.16 $\mu$m; Mohs' hardness 8.0) and dispersed with 3% hydrogen peroxide. When a polishing process is executed by utilizing the wheel 162 and the prepared slurry, polishing velocity against copper, tantalum, and silicon dioxide is respectively prescribed to be a maximum of 1200 Å/min., 130 Å/min., and 60 Å/min.

Initially, using the buff 161, a polishing process is executed (refer to FIG. 3). Next, using the polishing status measuring unit 300, a measuring process is executed (refer to FIG. 31). Then, based on the measured result, a polishing process is executed by operating the wheel 162 (refer to FIG. 32).

Initially, the wafer 101 is adhered to the wafer chuck 152 via vacuum pressure. Next, the X-axis ball screw 156 is rotated by way of driving the X-axis servo-motor 155 to shift the base plate 151 via the supporting unit 154 until the wafer 101 reaches a predetermined polishing starting position. Next, the wafer 101 is rotated via the wafer chuck 152 by driving a rotary mechanism built in the base plate 151. Simultaneously, the wheel 162 is rotated via the main-shaft spindle 172 by way of driving the main-shaft spindle motor 171 to further rotate the buff 161 via the pin 170.

Next, the Z-axis ball screw 178 is rotated by driving the Z-axis servo-motor 177 to cause the supporting unit 175 to descend itself along the Z-axis guide 176 until the polishing surface of the wheel 162 is apart from the surface of the wafer 101 adhered to the wafer-chuck 152 via vacuum pressure across a predetermined interval. Next, chemical solution is supplied from a supply unit (not shown) to the buff 161 via hollow portion of the shaft 165 and a slit 163*a* of the stationary metal base plate 163. Simultaneously, by way of feeding air to a pressurizing-side air-inlet 173*c* formed in a cylinder 173*b* of the air cylinder 173, the stationary metal base plate 163 is lowered via the piston 173*a* and the shaft 165.

When the above condition is entered, the stationary metal base plate 163 causes the spring 169 to be compressed to cause the polishing surface of the buff 161 to project itself from the polishing surface of the wheel 162 to press own polishing surface against the surface of the wafer 101. At the same time, the X-axis ball screw 156 is rotated by driving the X-axis servo-motor 155 to cause the base plate 151 to perform reciprocating movement via the supporting unit 154 whereby chemically and mechanically polishing the wafer 101. The absolute value of the polishing amount can be controlled mainly by the pressure of the air cylinder 173 and also by the velocity of the buff 161 passing through the wafer 101 (STP 1).

After completing the polishing process, supply of chemical solution is suspended. Next, the surface of the wafer 101 is treated with pure water and chemical solution via a nozzle (not shown) to remove polishing solution and slurry particles remaining thereon via washing to prevent surface oxidation from occurrence (STP 2).

Next, air is fed to an air-supply inlet 173*d* formed on an evacuating side of the cylinder 173*b* of the air cylinder 173 to lift the stationary metal base plate 163 via the piston 173*a* and the shaft 165 whereby causing the polishing surface of the buff 161 to leave the surface of the wafer 101. While this condition is present, the upper surface of the stationary metal base plate 163 is pressed against the bottom surface of the metal-tool flange 164 via resilient force of the spring 169. On the other hand, the polishing surface of the buff 161 remains being recessed from the polishing surface of the wheel 162.

Next, in order to measure actual polishing status on the wafer surface, the X-axis ball screw 156 is rotated via driving force of the X-axis servo-motor 155 to cause the base plate 151 to be shifted via the supporting unit 154 until the center (x=0 mm) of the wafer 101 arrives at a position right below the optical fiber 182. After completing the positioning process, light emitted from the light receiving/emitting unit 181 is irradiated onto the surface of the wafer 101 via the optical fiber 182. Then, light reflected from the wafer surface is received by the light receiving/emitting unit 181 via the optical fiber 182 and then superficial reflectivity of the wafer 101 is detected.

Simultaneously, the X-axis servo-motor 155 is driven to rotate the X-axis ball screw 156 to cause the base plate 151 to be shifted by a radial amount of the wafer 101 via the supporting unit 154. Next, superficial reflectivity of the wafer 101 is measured in relation to the X-axial position of the wafer 101, and then, based on the measured result, forwarding velocity pattern of the wafer 101 is corrected by operating the X-axis servo-motor 155 (STEP 3–5).

Next, the X-axis servo-motor 155 is driven to rotate the X-axis ball screw 156 to cause the base plate 151 to be shifted via the supporting unit 154 until the wafer 101 arrives at a predetermined Polishing starting position. Next, slurry is supplied from a supply unit (not shown) onto the surface of the wafer 101 via the nozzle 157. Simultaneously, by way of driving the Z-axis servo-motor 177 in the direction inverse from the rotating direction of the X-axis servo-motor 155, the Z-axis ball screw 178 is rotated to cause the supporting unit 175 to descend itself along the Z-axis guide 176.

Next, the polishing surface of the wheel 162 is pressed against the surface of the wafer 101. Then, based on the above-referred corrected forwarding velocity pattern, the X-axis ball screw 156 is rotated by driving the X-axis servo-motor 155 to cause the base plate 151 to perform reciprocating movement via the supporting unit 154 whereby chemically and mechanically polishing the wafer 101 (STP 6).

After completing the above wafer polishing process, supply of slurry is suspended. Next, pure water is poured onto the surface of the wafer 101 via the nozzle (not shown) to remove slurry and particles remaining thereon. Next, operating mode returns to STP 3 to measure the actually polished condition of the wafer 101 again. In consequence, if such an unscraped portion is still present on the wafer 101 (STP 4), then, operating mode proceeds to STP 5 to execute a polishing process again. On the other hand, if there is no unscraped portion on the whole surface of the wafer 101 (STP 4), then, the wafer 101 is superficially treated with pure water and chemical solution via the nozzle (not shown) to fully wash off slurry particles that may still remain on the wafer surface whereby preventing oxidation of the wafer surface from occurrence (STP 7), thus fully completing all the polishing processes.

As mentioned above, since the polishing process is executed by way of measuring actual polishing status of the wafer 101, unlike such a conventional practice to formulate a polishing process solely by way of controlling time, the wafer polishing method proposed by the present invention enables the processor to execute polishing processes without generating "underpolish" on the whole surface of the wafer 101 and by way of minimizing "overpolish", whereby promoting polishing precision and stability. Further, in the conventional practice, polishing process is formulated in anticipation of uneven effect of polishing, and thus, unnecessary margin is preset. This in turn causes practical specification required for execution of whole processes to intensify its own strictness, and yet, causes the polishing devices to fail to fully exert performance capability as a defect. However, the inventive polishing method ensures broader processing margin, improved yield, and reduced cost. Further, the conventional practice in the case of formulating polishing condition depends largely on skilled experience and perception of those skilled operators in the line, and yet, much labor is required for formulating the polishing process. However, according to the inventive polishing method, automation is practicable to eliminate dependence on human skill for implementing maintenance services.

As mentioned above, in the practical aspect for implementing the present invention, initially, a theoretical (ideal) removable amount is computed, and then, a proportional constant k is computed in comparison to the profile generated via a chemical-mechanical polishing process experimentally executed. The computed proportional constant k is utilized as a fixed value. Then, by applying Preston's equation, among a polishing condition prescribed by processing pressure P, relative velocity v, and polishing time t, a proper polishing time t is computed by way of utilizing the processing pressure P and the relative velocity v as the fixed values. Next, the computed proper polishing time t is input into a controller 200 in conjunction with other parameters. Based on the input data, the controller 200 feeds a control signal CTL1 to the X-axis servo-motor 155 to control velocity of the wafer 101 in the X-axial direction. The controller 200 also feeds another control signal CTL2 to the main-shaft spindle motor 171 whereby controlling the number of the rotation of the motor 171. The controller 200 further feeds another control signal CTL3 to the Z-axis servo-motor 177 to control positioning of a processing head 160 in the Z-axial direction. As a result, it is possible to assuredly prevent dishing and erosion from occurrence without being swayed by skill and perception of skilled operators. Further, in the course of leveling off copper film or the like via a polishing process, it is possible to improve the polishing rate while preserving initial capability to relax stepwise difference caused by projections and recesses, whereby making it possible to secure stabilized high processing precision.

The above description has referred to such a system capable of correcting and improving dimensional precision at the time of suspending a chemical-mechanical polishing of copper film via such an arrangement to initially measure distribution of surface reflectivity inside of a measuring apparatus and then further measure such a portion requiring removal via the measuring apparatus before automatically formulating a practicable condition for processing the corresponding portion by referring to the measured result. Further, it is also possible to formulate such a system capable of correcting and improving processing precision and stability of the chemical-mechanical polishing process via such an arrangement which initially measures a specific portion requiring removal via a measuring apparatus by way of executing an optical measurement of film thickness inside of the measuring apparatus when executing a chemical-mechanical polishing process of the ILD (interlayer dielectric) and then automatically feeds back a specific condition to properly process the corresponding portion by referring to the measured result.

Further, when defining a proper condition to execute a chemical-mechanical polishing process against copper wiring, it is also possible to formulate such a system which initially computes such a parameter requiring correction of the removable amount by way of measuring variation of the off-line sheet resistance and then defines a condition to secure uniformity by way of automatically correcting condition of the computed parameter.

Figure 35:
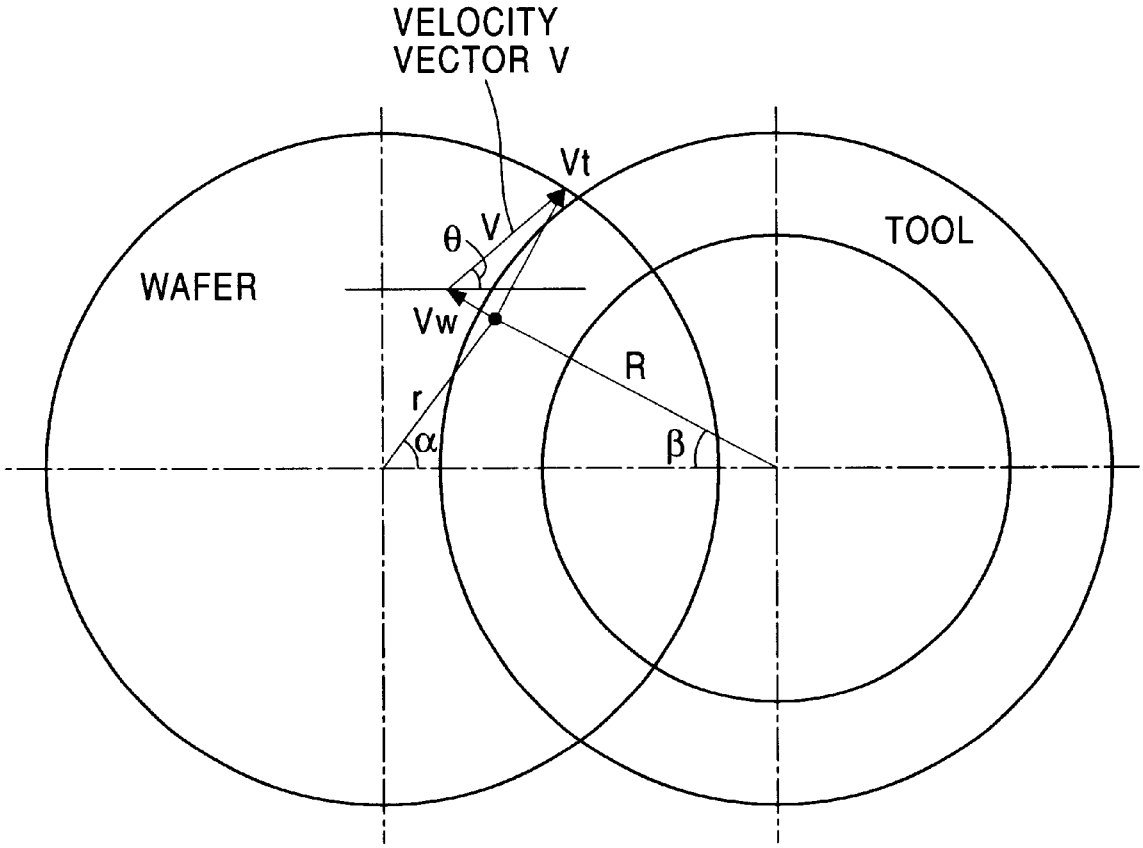
FIG. 35 is explanatory of a suitable polishing direction.
Figure 36:
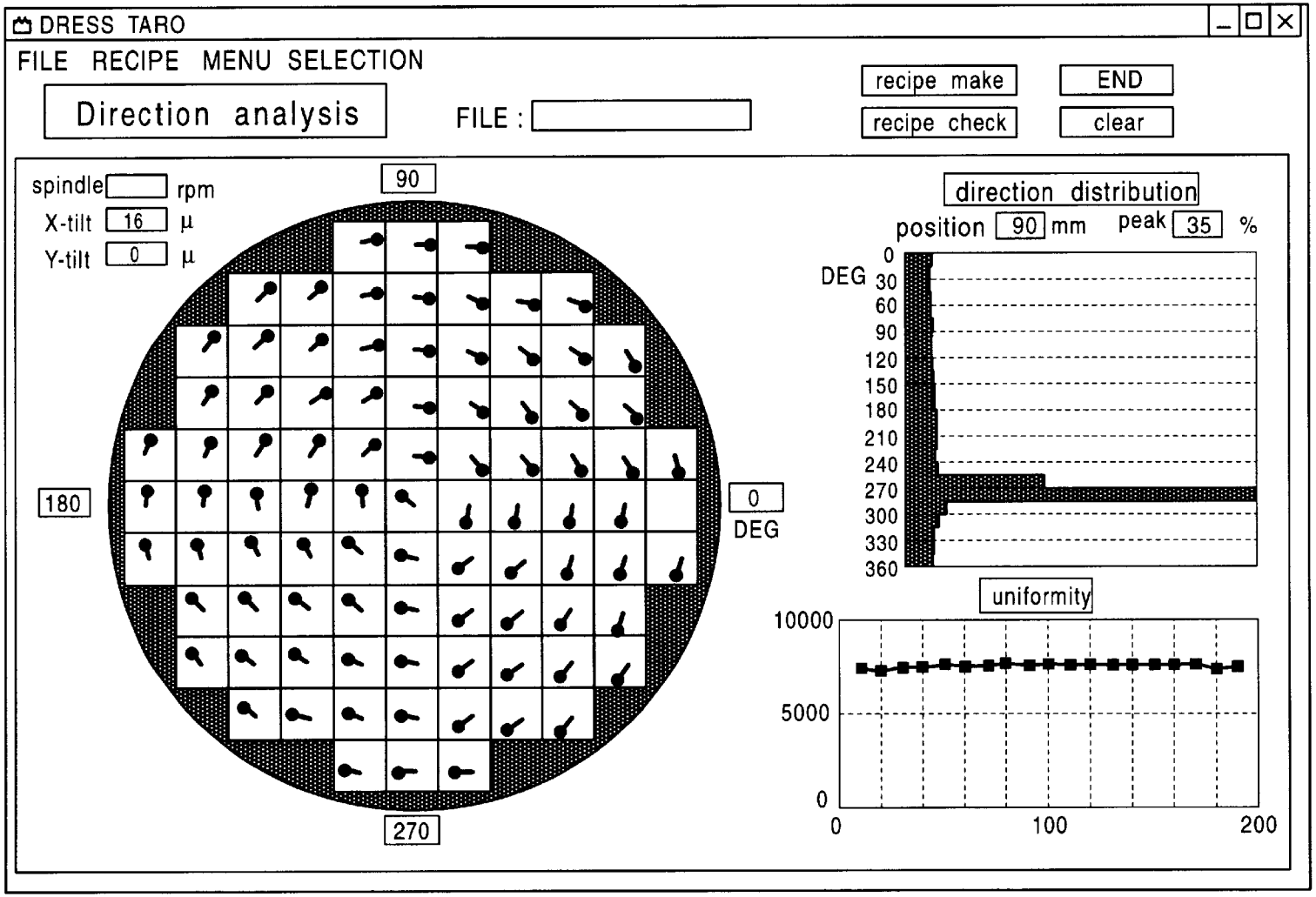
FIG. 36 is explanatory of an inappropriate polishing direction.
Figure 37:
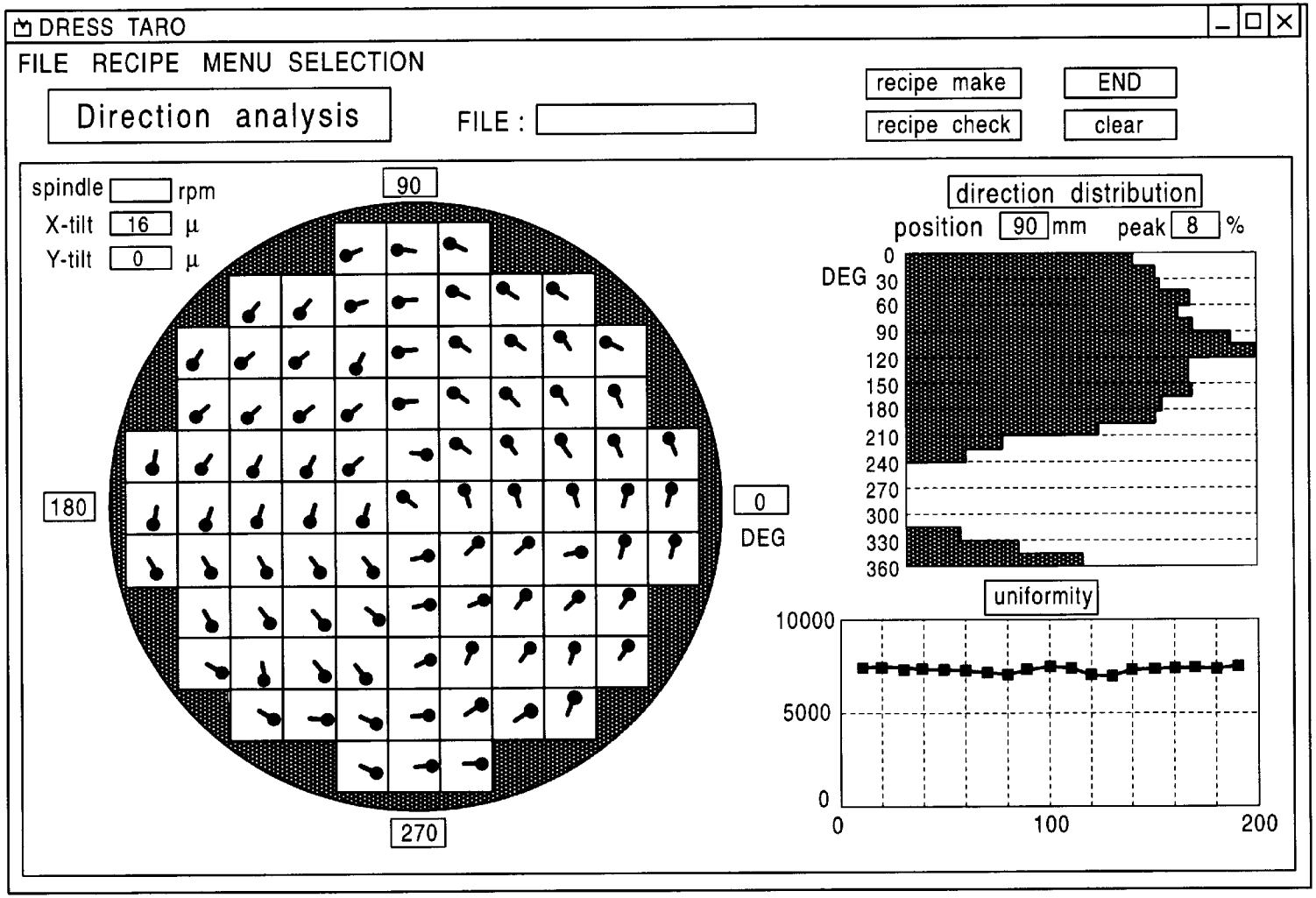
FIG. 37 is explanatory of a suitable polishing direction.
Figure 38:
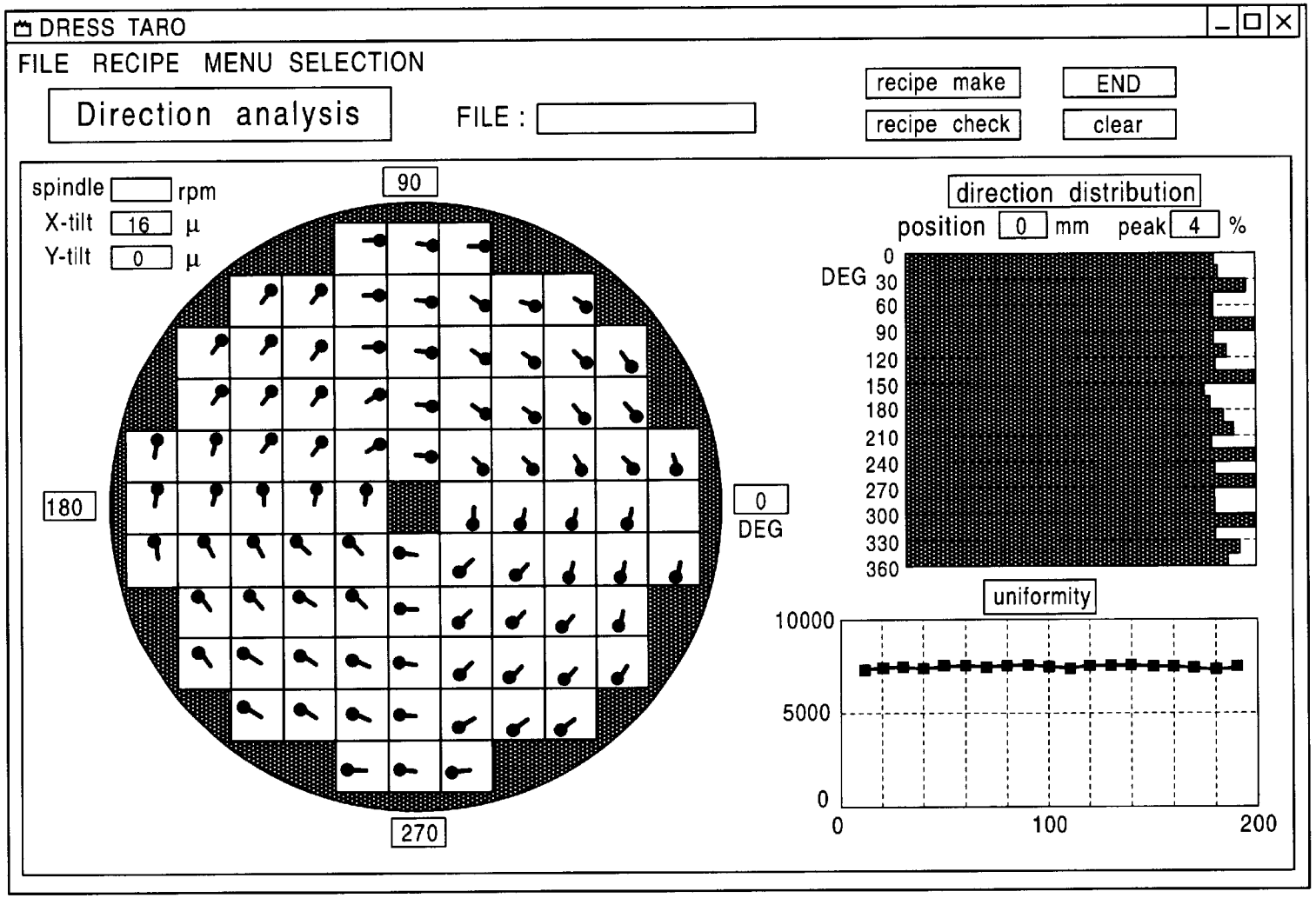
FIG. 38 is explanatory of a suitable polishing direction.
Figure 39A:
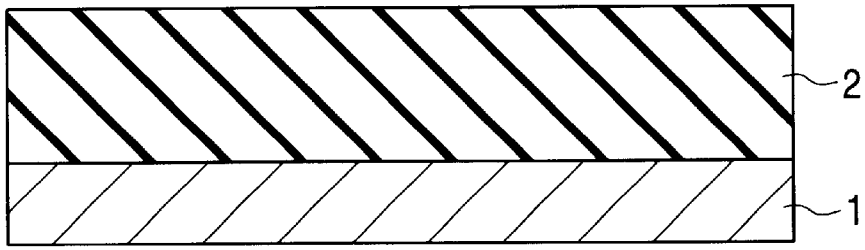
FIGS. 39A to 39F are cross-sectional views for explanatory of the method of forming copper wiring based on a conventional dual damascene process.
Figure 39B:
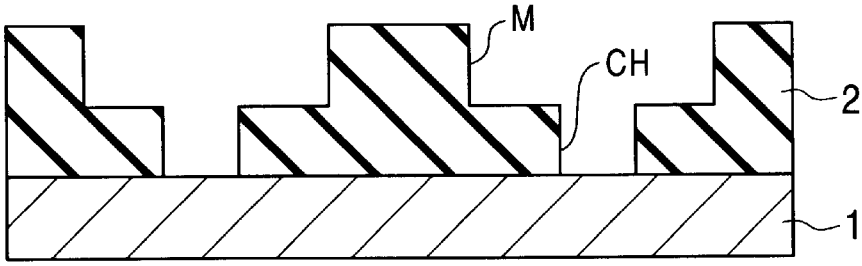
Figure 39C:
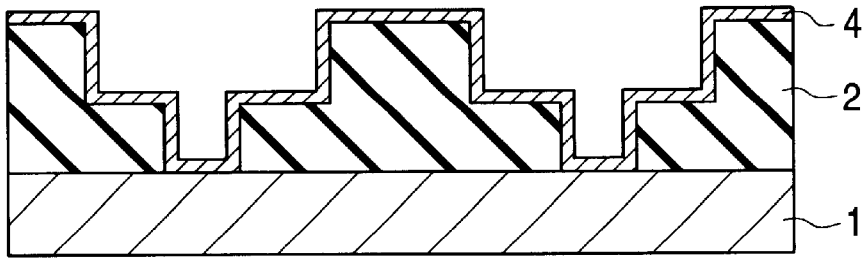
Figure 39D:
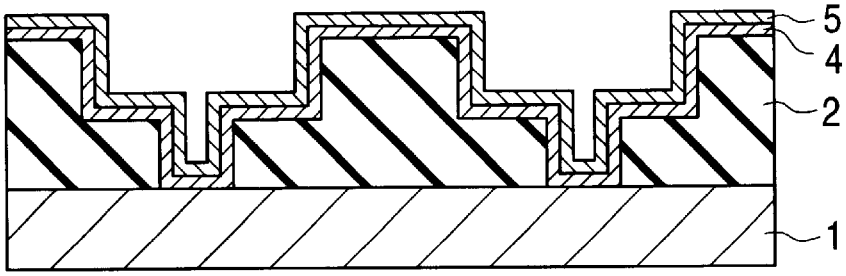
Figure 39E:
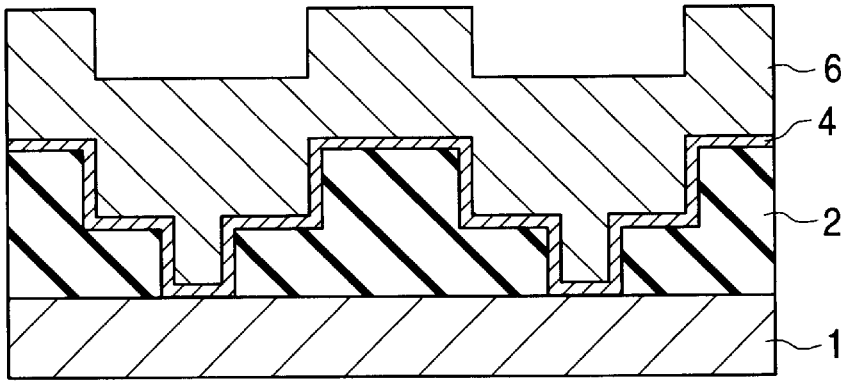
Figure 39F:
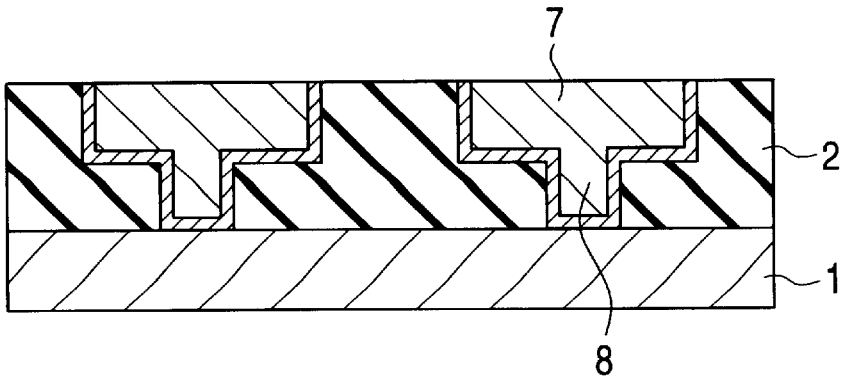
Figure 40:
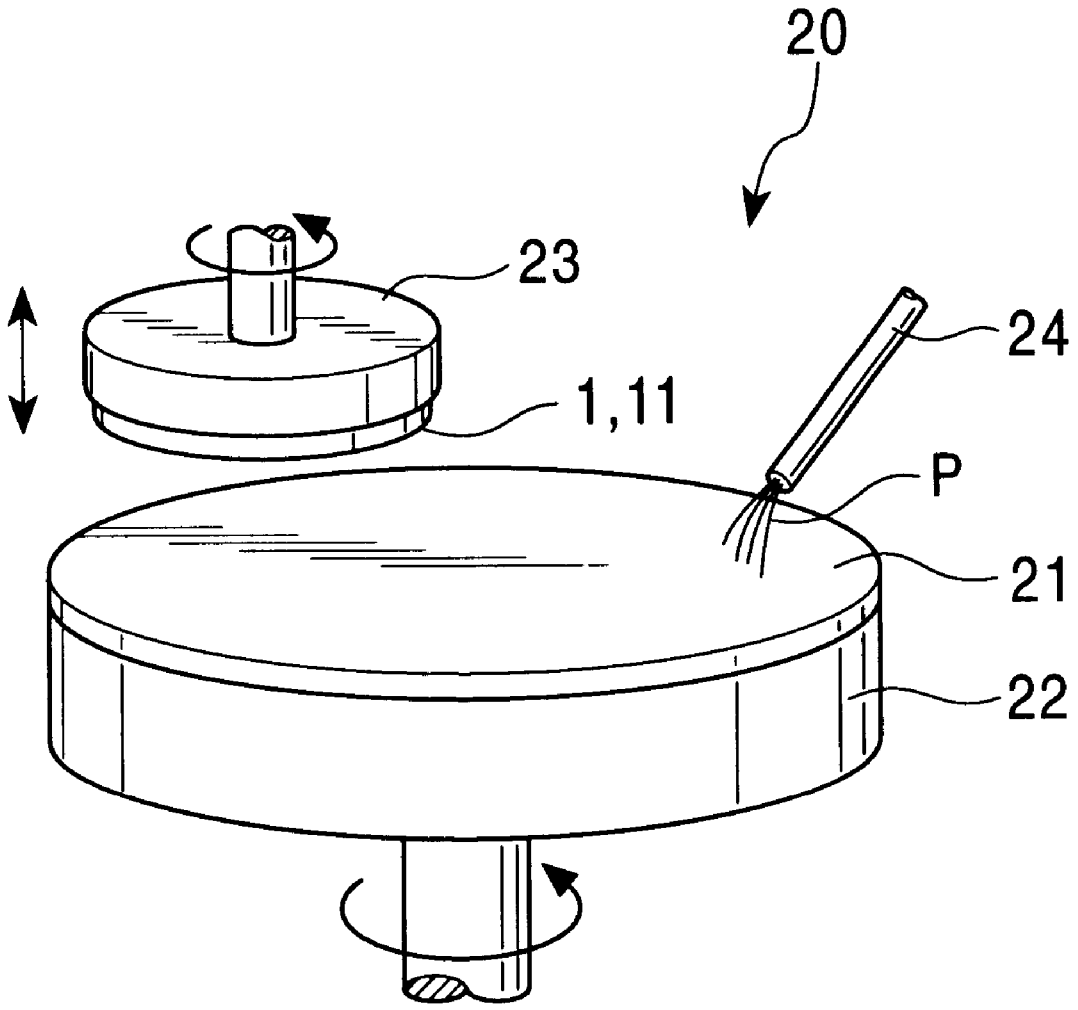
FIG. 40 is a perspective view designating a brief structure of a conventional surface-leveling polishing apparatus.
Figure 41A:
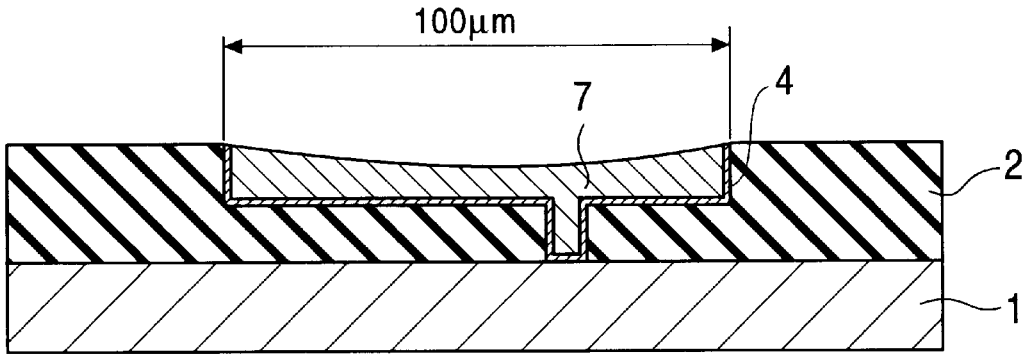
FIG. 41 is explanatory of a problem in the copper-film polishing process via chemical-mechanical polishing process.
Figure 41B:
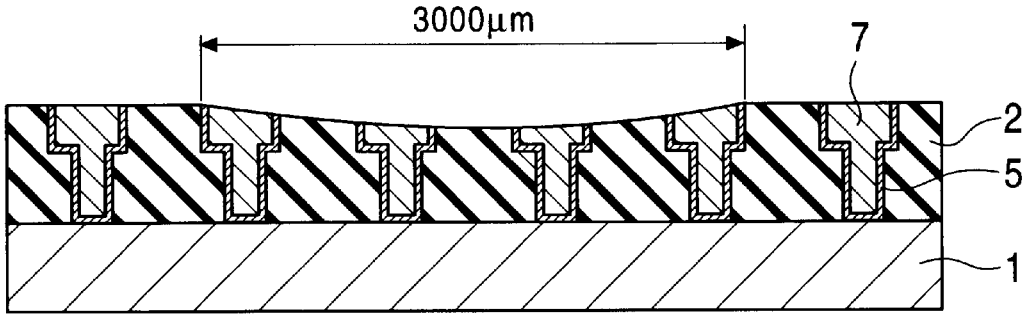
Figure 41C:
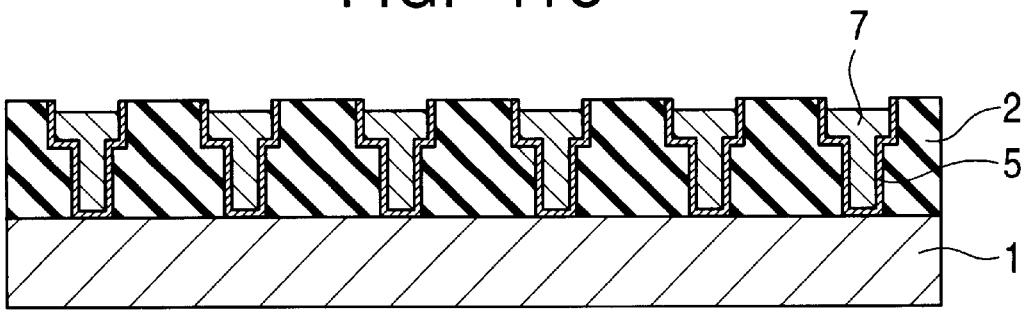
Figure 42:
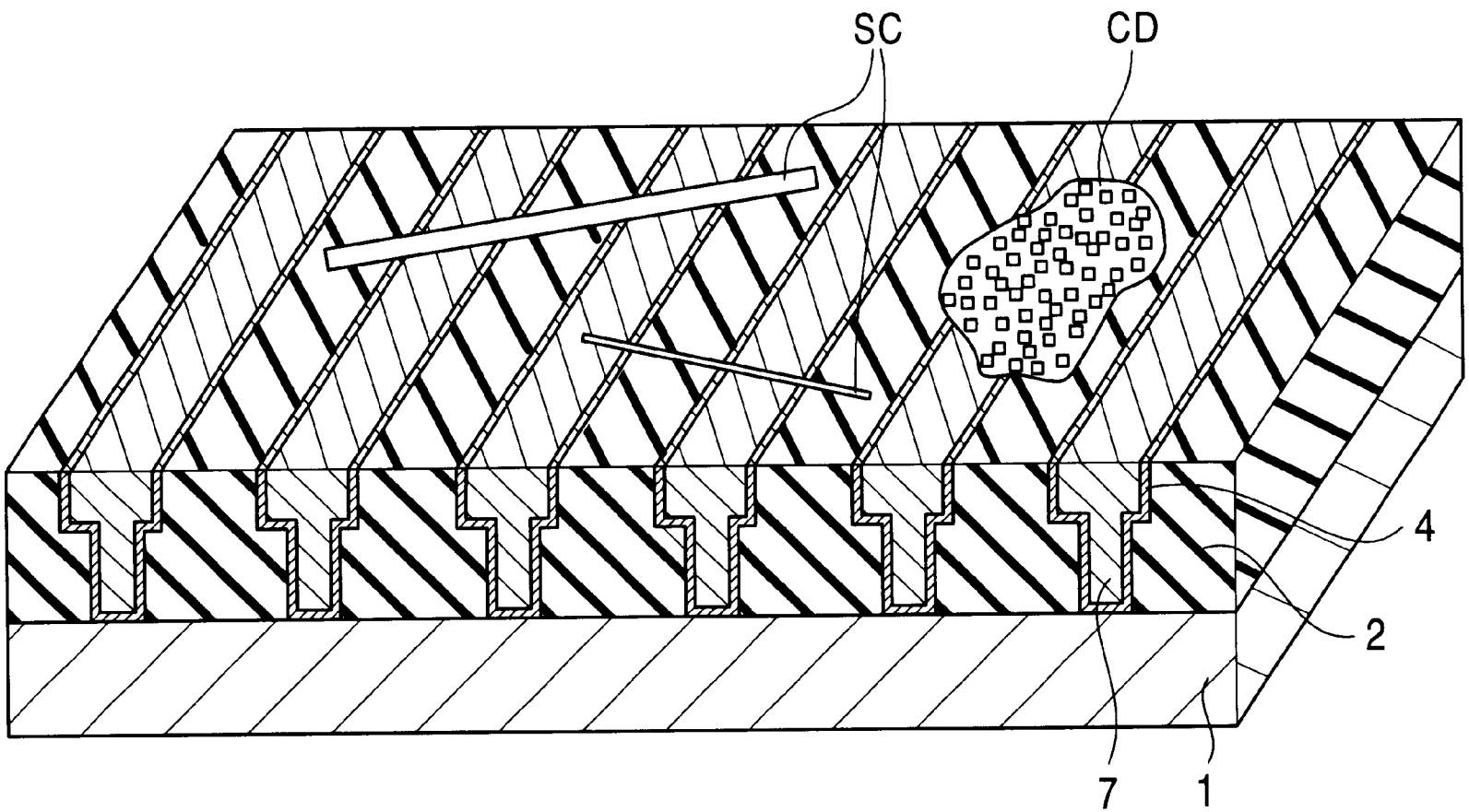
FIG. 42 is explanatory of scratch and chemical damage generated in the course of polishing copper film via the chemical mechanical polishing method.

In the course of polishing the wafer 101 by operating the polishing apparatus 100, a specific direction θ shown in FIG. 35 is determined via an equation (9) shown below, and then, a polishing operation is executed in this direction. However, this in turn causes a peak to be generated in the polishing directivity as shown in FIG. 36 as a disadvantage. Nevertheless, it is possible to relax the peak of the polishing directivity as shown in FIG. 37. Alternatively, it is possible to average the polishing direction in the center of the wafer as shown in FIG. 38.

$$\theta=\pi/2-\cos^{-1}(Vt^2+Vt\cdot Vw\cos(\alpha+\beta)/Vt/(Vw^2+Vt^2+2Vt\cdot Vw\cos(\alpha+\beta)+\alpha)^{1/2} \quad (9)$$

Although the invention has been described in its preferred form with a certain degree of particularity, obviously many changes and variations are possible therein. It is therefore to be understood that the present invention may be practiced otherwise than as specifically described herein without departing from the scope and the sprit thereof.

What is claimed is:

1. A polishing method for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, said method comprising the steps of:

computing distribution of removable amount on the surface of said polishing object, generated by influence of a variety of processing parameters in accordance with a proportional constant k determined by a polishing status and Preston's equation prescribed by said polishing condition;

computing a proportional constant k that enables said distribution of removable amount to secure uniform levelness;

computing distribution of removable amount based on said proportional constant k as a fixed value; and establishing said polishing condition that enables distribution of removable amount using said proportional constant k as a fixed value to secure uniform levelness, wherein said polishing object is a semiconductor wafer, and wherein polishing of said wafer is executed in either one of a direction enabling to relax peak of polishing directivity prescribed while being polished by said polishing means and a direction enabling polishing direction in a center portion of said wafer to be averaged.

2. The polishing method according to claim 1, further comprising the steps of:

detecting a portion requiring removal by way of measuring film thickness of said polishing object; and automatically generating a condition for processing said portion requiring removal in accordance with a detected value.

3. A polishing method for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, said method comprising the steps of:

computing distribution of removable amount on, the surface of said polishing object, generated by influence of a variety of processing parameters in accordance with a proportional constant k determined by a polishing status and Preston's equation prescribed by said polishing condition;

computing a proportional constant k that enables said distribution of removable amount to secure uniform levelness;

computing distribution of removable amount based on said proportional constant k as a fixed value; and establishing said polishing condition that enables distribution of removable amount using said proportional constant k as a fixed value to secure uniform levelness, wherein said polishing condition of said Preston's equation is set by prescribing said polishing time t in a case where said processing pressure P and said relative velocity v are respectively utilized as a fixed value, wherein said polishing object is a semiconductor wafer, and wherein polishing of said wafer is executed in either one of a direction enabling to relax peak of polishing ditectivity prescribed while being polished by said polishing means and a direction enabling polishing direction in a center portion of said wafer to be averaged.

4. A polishing method for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, said method comprising the steps of:

computing distribution of removable amount on the surface of said polishing object, generated by influence of a variety of processing parameters in accordance with a proportional constant k determined by a polishing status and Preston's equation prescribed by said polishing condition;

computing a proportional constant k that enables said distribution of removable amount to secure uniform levelness;

computing distribution of removable amount based on said proportional constant k as a fixed value; and establishing said polishing condition that enables distribution of removable amount using said proportional constant k as a fixed value to secure uniform levelness, wherein said polishing condition of said Preston's equation is set by prescribing said relative velocity v in a case where said processing pressure P and said polishing time t are respectively utilized as a fixed value, wherein said polishing object is a semiconductor wafer, and wherein polishing of said wafer is executed in either one of a direction enabling to relax peak of polishing directivity prescribed while being polished by said polishing means and a direction enabling polishing direction in a center portion of said wafer to be averaged.

5. A polishing method for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, said method comprising the steps of:

computing distribution of removable amount on the surface of said polishing object, generated by influence of a variety of processing parameters in accordance with a proportional constant k determined by a polishing status and Preston's equation prescribed by said polishing condition;

computing a proportional constant k that enables said distribution of removable amount to secure uniform levelness;

computing distribution of removable amount based on said proportional constant k as a fixed value;

establishing said polishing condition that enables distribution of removable amount using said proportional constant k as a fixed value to secure;

detecting variation of superficial reflectivity of said polishing object;

identifying an unscraped remaining portion of said polishing object based on a detected value; and automatically generating a polishing condition applicable to said unscraped remaining portion and a portion other than said unscraped remaining portion.

6. A polishing method for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, said method comprising the steps of:

computing distribution of removable amount on the surface of said polishing object, generated by influence of a variety of processing parameters in accordance with a proportional constant k determined by a polishing status and Preston's equation prescribed by said polishing condition;

computing a proportional constant k that enables said distribution of removable amount to secure uniform levelness;

computing distribution of removable amount based on said proportional constant k as a fixed value;

establishing said polishing condition that enables distribution of removable amount using said proportional constant k as a fixed value to secure;

computing parameters required for correcting removable amount by way of measuring variation of off-line sheet resistance; and generating such a condition suitable for securing uniformity by automatically correcting the parameters.

7. A polishing apparatus for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, wherein said polishing condition is established so that, in a case where a proportional constant k enabling distribution of a first removable amount on the surface of said polishing object generated by influence of a variety of parameters obtained in accordance with a proportional constant k defined by a polishing status and Preston's equation prescribed by said polishing condition is utilized as a fixed value, distribution of a second removable amount is set to secure uniform levelness, wherein said polishing object is a semiconductor wafer, and wherein said polishing means executes polishing of the wafer in either one of a direction enabling to relax peak of polishing directivity and a direction enabling polishing direction in the center portion of the wafer to be averaged.

8. A polishing apparatus for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, wherein said polishing condition is established so that, in a case where a proportional constant k enabling distribution of a first removable amount on the surface of said polishing object generated by influence of a variety of parameters obtained in accordance with a proportional constant k defined by a polishing status and Preston's equation prescribed by said polishing condition is utilized as a fixed value, distribution of a second removable amount is set to secure uniform levelness, wherein said polishing condition of said Preston's equation is set by prescribing said polishing time t in a case where said processing pressure P and said relative velocity v are respectively utilized as a fixed value, wherein said polishing object is a semiconductor wafer, and wherein said polishing means executes polishing of the wafer in either one of a direction enabling to relax peak of polishing directivity and a direction enabling polishing direction in the center portion of the wafer to be averaged.

9. A polishing apparatus for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, wherein said polishing condition is established so that, in a case where a proportional constant k enabling distribution of a first removable amount on the surface of said polishing object generated by influence of a variety of parameters obtained in accordance with a proportional constant k defined by a polishing status and Preston's equation prescribed by said polishing condition is utilized as a fixed value, distribution of a second removable amount is set to secure uniform levelness, wherein said polishing condition of said Preston's equation is set by prescribing said relative velocity t in a case where said processing pressure P and said polishing time t are respectively utilized as a fixed value, wherein said polishing object is a semiconductor wafer, and wherein said polishing means executes polishing of the wafer in either one of a direction enabling to relax peak of polishing directivity and a direction enabling polishing direction in the center portion of said wafer to be averaged.

10. A polishing apparatus for flatly polishing a surface of a polishing object by way of causing polishing means to be shifted relative to the surface of said polishing object in a predetermined direction in accordance with a polishing condition prescribed by processing pressure P, relative velocity v between said polishing means and said polishing object, and polishing time t, detecting means for detecting variation of superficial reflectivity of said polishing object; and controlling means which, based on a detected value, identifies unscraped remaining portion of said polishing object and automatically generates a polishing condition applicable to said unscraped remaining portion and a portion other than said unscraped portion, wherein said polishing condition is established so that, in a case where a proportional constant k enabling distribution of a first removable amount on the surface of said polishing object generated by influence of a variety of parameters obtained in accordance with a proportional constant k defined by a polishing status and Preston's equation prescribed by said polishing condition is utilized as a fixed value, distribution of a second removable amount is set to secure uniform levelness.

* * * * *